US012134132B2

(12) United States Patent
Hussein et al.

(10) Patent No.: US 12,134,132 B2
(45) Date of Patent: Nov. 5, 2024

(54) METHOD TO FORM METAL MATRIX COMPOSITE REINFORCED WITH EGGSHELL

(71) Applicant: KING FAHD UNIVERSITY OF PETROLEUM AND MINERALS, Dhahran (SA)

(72) Inventors: Mohamed Abdrabou Hussein, Dhahran (SA); Mohammed Abdul Azeem, Dhahran (SA); A. Madhan Kumar, Dhahran (SA); Noha Mohamed Emara, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 101 days.

(21) Appl. No.: 17/847,846

(22) Filed: Jun. 23, 2022

(65) Prior Publication Data

US 2023/0415230 A1 Dec. 28, 2023

(51) Int. Cl.
*B22F 7/00* (2006.01)
*B22F 1/052* (2022.01)
(Continued)

(52) U.S. Cl.
CPC ..... *B22F 7/008* (2013.01); *B22F 1/052* (2022.01); *B22F 1/142* (2022.01); *B22F 3/12* (2013.01);
(Continued)

(58) Field of Classification Search
CPC ..... B22F 2301/058; B22F 2301/205
See application file for complete search history.

(56) References Cited

U.S. PATENT DOCUMENTS 7,954,733 B2 6/2011 Vlad
10,815,748 B1 * 10/2020 Meeks ..... B22F 3/02
(Continued)

FOREIGN PATENT DOCUMENTS

BR 122018070775-5 B1 4/2020
CN 101347639 A * 1/2009
(Continued)

OTHER PUBLICATIONS

Parande et al. Utilizing low-cost eggshell particles to enhance the mechanical response of Mg-2.5Zn magnesium alloy matrix. Adv. Eng. Mater. 2018, 20, 1700919. 9 pp. (Year: 2018).*
(Continued)

*Primary Examiner* — Paul A Wartalowicz
*Assistant Examiner* — Stephani Hill
(74) *Attorney, Agent, or Firm* — Oblon, McClelland, Maier & Neustadt, L.L.P.

(57) ABSTRACT

A method to form a metal matrix composite reinforced with eggshell (ES). The method includes preparing an ES powder, blending and milling the ES powder with at least one metal powder selected from the group consisting of magnesium (Mg), zirconium (Zr) to form a powder mixture, compacting and sintering the powder mixture to form the metal matrix composite. In addition, a Mg—Zr-ES metal matrix composite with improved corrosion resistance, having an amount of magnesium from 95 to 97 wt. %, an amount of zirconium from 1 to 2 wt. %, and an amount of ES from 1 to 4 wt. %, may be used for biomedical applications.

15 Claims, 16 Drawing Sheets

(51) Int. Cl.

| | |
|---|---|
| ***B22F 1/142*** | (2022.01) |
| ***B22F 3/12*** | (2006.01) |
| ***C22C 1/04*** | (2023.01) |
| ***C22C 1/05*** | (2023.01) |

(52) U.S. Cl.
CPC ..... *C22C 1/0408* (2013.01); *C22C 1/05* (2013.01); *B22F 2301/058* (2013.01); *B22F 2301/205* (2013.01); *B22F 2302/45* (2013.01); *B22F 2304/10* (2013.01)

(56) References Cited

U.S. PATENT DOCUMENTS

| | | | | |
|---|---|---|---|---|
| 2010/0261034 | A1 | 10/2010 | Cardarelli | |
| 2021/0130930 | A1 * | 5/2021 | Hussein | C22C 1/0408 |

FOREIGN PATENT DOCUMENTS

| | | | | |
|---|---|---|---|---|
| CN | 104099501 | A | * | 10/2014 |
| CN | 111514372 | A | | 8/2020 |
| CN | 109256535 | B | | 3/2021 |
| CS | 14023 | | * | 2/1972 |
| WO | WO-2022144498 | A1 | * | 7/2022 |

OTHER PUBLICATIONS

Schade. Milling of brittle and ductile materials. ASM Handbook, vol. 7, Powder Metallurgy. 2015. pp. 77-87. Citations as page: column:paragraph. (Year: 2015).*
CN 101347639 machine translation (Year: 2009).*
Schade. Blending and premixing of metal powders and binders. ASM Handbook, vol. 7, Powder Metallurgy. 2015. pp. 88-91. (Year: 2015).*
Luk. Bulk properties of powder. ASM Handbook, vol. 7, Powder Metallurgy. 2015. pp. 111-126. (Year: 2015).*
Turan et al. Wear and corrosion properties of low-cost eggshell-reinforced green AZ91 matrix composites. Canadian Metallurgy Quarterly. 2022, vol. 61, No. 2, 155-171. (Year: 2022).*
Aydin. Effect of solid waste materials on properties of magnesium matrix composites—A systematic review. Journal of Magnesium and Alloys 10 (2022) 2673-2698. (Year: 2022).*
CS 14023 machine translation (Year: 1972).*
Demirdal et al. The influence of low-cost eggshell on the wear and electrochemical corrosion behavior of novel pure Mg matrix composites. Materials Chemistry and Physics 277 (2022) 125520. (Year: 2022).*
Xi et al. Ti—6Al—4V particle reinforced magnesium matrix composite by powder metallurgy. Materials Letters 59 (2005) 1831-1835. (Year: 2005).*
Hussein et al. Processing and in vitro corrosion analysis of sustainable and economical eggshell reinforced Mg and Mg—Zr matrix composite for biomedical applications. Materials Today Communications 32 (2022) 103944. (Year: 2022).*
Liu et al. Effect of Cd on microstructure and damping capacities of Mg—Zr PM alloy. Advanced Materials Research vols. 287-290. pp. 632-649. Online Jul. 4, 2011. (Year: 2011).*
Ramanujam et al. Experimental investigations on mechanical properties of AZ31/eggshell particle-based magnesium composites. Advances in Materials Science and Engineering. vol. 2022, Article IS 4883764, 7 pages. (Year: 2022).*
Dictionary of Metals Cobb ed. ASM International, 2012, pp. 36-64 (Year: 2012).*
Seetharaman et al., Materials 6, 1940-55, 2013 (Year: 2013).*
Jayalakshmi et al., J. Alloys Compd. 565, 56-65, 2013 (Year: 2013).*
CN 104099501 machine translation (Year: 2014).*
Almomani, et al. ; Investigation of mechanical and tribological properties of hybrid green eggshells and graphite-reinforced aluminum composites ; Springer Link Technical; Paper ; Dec. 14, 2019 ; Abstract Only ; 2 Pages.
Shahin, et al. ; Nano-tribological behavior of graphene nanoplatelet-reinforced magnesium matrix nanocomposites ; Journal of Magnesium and Alloys 9 ; pp. 895-909 ; Nov. 5, 2020 ; 15 Pages.
Hayajneh, et al. ; Effects of Waste Eggshells addition on Microstructures, Mechanical and Tribological Properties of Green Metal Matrix Composite ; Sci Eng Compos Mate 2019 ; pp. 423-434 ; May 21, 2019 ; 12 Pages.

* cited by examiner

METHOD TO FORM METAL MATRIX COMPOSITE REINFORCED WITH EGGSHELL

BACKGROUND

Technical Field

The present disclosure is directed towards a method to form a metal matrix composite, particularly, the metal matrix composite reinforced with eggshell, more particularly a powder metallurgy method to form the metal matrix composite reinforced with the eggshell.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

A biomaterial implant is a construct with impregnated pharmaceutical products which can be placed inside a patient's body, that permits the prolonged release of a drug over an extended period. Biomaterial implants are frequently required to restore function following a bone loss, or a degeneration caused by accidents, sports injuries, or normal aging process [Ducheyne et al., Nat. Mater. 11, 652-654, 2012; Kendall et al., Nat. Nanotechnol. 11, 206-210, 2016]. Cobalt, iron, and titanium-based alloys have been utilized for preparation of the biomaterial implants [Hussein et al., Materials 8, 2749-2768, 2015; Hussein et al., Mater. Des. 87C, 693-700, 2015]. However, the elastic modulus of such alloys is higher than the bone which can cause a stress shielding. In addition, the biomaterial implants require costly post-surgery care during the healing process.

Magnesium is a biocompatible and biodegradable element, possessing a lower value of elastic modulus (45 GPa), which is in the range of the elastic modulus of the human bone (40-57 GPa), minimizing the bone shielding effect [Li et al., Surf. Coat. Technol., 185, 92-98, 2004; Ong et al., Mater. Sci. Eng. C 78, 647-652, 2017]. However, the rapid rate of degradation of pure magnesium in the body affects its mechanical and corrosion properties. The mechanical integrity of the implant in the body should be maintained for approximately 12 weeks, however, magnesium alloy generally maintains its mechanical stability for only 6-8 weeks [Khalajabadi et al., J. Alloys Compd. 696, 768-781, 2017]. Magnesium has been alloyed with elements such as aluminum, zinc, zirconium, and rare earth elements to improve its mechanical properties and corrosion resistance [Shahin et al., J. Alloys Compd. 828, 154461, 2020]. However, magnesium alloys are not always biocompatible due to the presence of hazardous alloying elements such as aluminum. Furthermore, in the physiological environment, aluminum-containing magnesium alloys such as AZ91, AZ61, AZ31, and AJ62 display pitting and stress corrosion by establishing galvanic couples in magnesium matrices [Shahin et al., J. Alloys Compd. 828, 154461, 2020; Li et al., J. Mater. Sci. Technol. 29, 489-502, 2013].

Reinforcement materials have also been employed for improving the corrosion protection and mechanical characteristics of magnesium matrices for biomedical applications [Ali et al., J. Alloys Compd. 792, 1162-1190, 2019; Suryanarayana et al., Prog. Mater. Sci. 58, 383-502, 2013]. Metal matrix composites have been prepared to enhance the hardness, and corrosion protection of the metal [Ali et al., J. Alloys Compd. 792, 1162-1190, 2019; Suryanarayana et al., Prog. Mater. Sci. 58, 383-502, 2013]. Recent studies have shown that variation in strength and corrosion protection can be obtained by using ceramic reinforcements. Magnesium-based alloys or composites comprising Cu, Ti, Al, $TiO_2$, ZnO, $Al_2O_3$, $ZrO_2$, and $TiB_2$ have been prepared to attain the required mechanical properties [Suryanarayana et al., Prog. Mater. Sci. 58, 383-502, 2013; Nie et al., J. Magnes. Alloy. 9, 57-77, 2021; Bommala et al., J. Magnes. Alloy. 7, 72-79, 2019; Sezer et al., J. Magnes. Alloy. 6, 23-43, 2018; Gu et al., J. Biomed. Mater. Res. Part B Appl. Biomater. 99B, 127-134, 2011; Hussein et al., JOM 74, 981-989, 2022; Meenashisundaram et al., Mater. Des. 65, 104-114, 2015; Sankaranarayanan et al., J. Alloys Compd. 615, 211-219, 2014; Dutta et al., ACS Biomater. Sci. Eng. 6, 4748-4773, 2020; Shahin et al., Acta Biomater. 96, 1-19, 2019; Ali et al., JOM 72, 1186-1194, 2020].

Metallic material grain refinement enables easier passivation of surfaces by reducing the size of second phase intermetallic particles along grain boundaries, hence improving corrosion protection [Ralston et al., Scr. Mater. 63, 1201-1204, 2010; Li et al., Acta Biomater. 8, 3177-3188, 2012]. Grain refinement of magnesium metal matrices by addition of graphene nanoplatelets, [Li et al., Acta Biomater. 8, 3177-3188, 2012], or beta-tricalcium phosphate [StJohn et al., Metall. Mater. Trans. A 36, 1669-1679, 2005] are reported. Zirconium is soluble in magnesium up to 2.69 wt. % [Paul et al., Trends Biomater. Artif. Organs 25, 91-94, 2011] and works as grain refinement [Ma et al., Mater. Des. 56, 305-312, 2014]. Zirconium and its oxide improve corrosion protection, biocompatibility, and cell adhesion as well as reduce the ability of magnesium alloys to reduce the bacterial adhesion [Zhao et al., Acta Biomater. 10, 544-556, 2014]. The magnesium-based composites have been fabricated by various methodologies, e.g., stir casting [Ma et al., J. Biomed. Mater. Res. Part B Appl. Biomater. 101B, 870-877, 2013; Khosroshahi et al., Mater. Sci. Eng. A 595, 284-290, 2014; Khanra et al., Mater. Sci. Eng. A, 527, 6283-6288, 2010], squeeze casting [Chen et al., J. Mater. Sci. Technol. 32, 858-864, 2016], liquid infiltration [Gu et al., J. Biomed. Mater. Res. Part B Appl. Biomater. 99B, 127-134, 2011], and powder metallurgy process [Stüpp et al., Magnesium Technology, Springer, 425-429, 2015; Zheng et al., Acta Biomater. 6, 1783-1791, 2010; Stalin et al., Metallofiz. Noveishie Tekhnol. 42, 497-509, 2020; Kumar et al., J. Magnes. Alloy. 8, 883-898, 2020; Kumar et al., Arch. Metall. Mater. 62, 1851-1856, 2017]. In powder metallurgy, the reinforcement can be distributed uniformly inside the matrix in the absence of or in the presence of minimum matrix-reinforcement contact.

Eggshell (ES) is a by-product of chicken farming and is one of the most affordable naturally occurring reinforcing materials due to its high calcium content. The ES is non-toxic and has a low density [Murakami et al., Food Sci. Technol. 27, 658, 2007], primarily containing $CaCO_3$ and organic compounds, and is more stable than commercial $CaCO_3$ [Murakami et al., Food Sci. Technol. 27, 658, 2007]. The favorable properties of the ES suggest that it could be used in biomedical applications. The ES, or hydroxyapatite generated from the ES has been used as a bone graft material [Kattimani et al., J. Biomat. Appl. 34, 597-614, 2019; Lee D D S et al., Oral Surg. Oral Med. Oral Pathol. Oral Radiol. 113, 348-355, 2012]. The ES has also been employed as a reinforcement in magnesium matrix composite fabricated using disintegrated melt deposition to study its influence on the damping behavior [Parande et al., Compos. B. Eng. 182, 107650, 2020].

CN111514372A discloses a nanocomposite prepared by mixing magnesium ions and eggshells. The nanocomposite has the characteristics of being natural, green, and environmentally friendly, and can sufficiently utilize waste eggshells containing a large amount of $CaCO_3$. Medical instruments such as scaffolds and the like prepared from the nanocomposite as a raw material can be used for bone repair.

US20100261034A1 discloses a lightweight, high strength, and corrosion-resistant composite metallic material. The composite metallic material comprises a low-density core material, and a refractory, corrosion-resistant protective layer, wherein the core material includes magnesium and zirconium metals. The composite material is suitable for making biomaterials, corrosion-resistant equipment, and industrial electrodes.

U.S. Pat. No. 9,945,012B2 discloses metal matrix composites comprising calcium. The metal matrix composite allows incorporation of small and large amounts of ceramic into the metal. U.S. Pat. No. 9,945,012B2 also discloses a method to prepare the metal matrix composite. The method involves mixing reinforcement with aluminum-containing molten or semisolid metal or alloy and calcium and cooling the mixture to produce the solid metal matrix composite, wherein the metal includes magnesium.

Almomani et al. [J. Braz. Soc. Mech. Sci. Eng. 42, 1-13, 2020] discloses a hybrid of green eggshells and graphite-reinforced aluminum composite. Sintering additives such as magnesium and tin were also used to improve the density of the composite.

Shahin et al. [J. Magnes. Alloy. 9, 895-909, 2021] discloses a corrosion-resistant and wear resistant graphene nanoplatelet-reinforced magnesium matrix nanocomposites. The nanocomposite comprises zirconium as an alloying element and graphene nanoplatelets as a nano-reinforcement material. The nanocomposite was fabricated using powder metallurgy.

Despite these recent advances in the preparation of the metal matrix composite, the drawbacks of each of the aforementioned methods such as magnesium matrix composite prepared without eco-friendly reinforcing material indicate that there is still a need for a novel, effective, green reinforcement particles for the preparation of magnesium matrix composite with improved corrosion, mechanical, and biodegradable properties for orthopedic applications.

SUMMARY OF THE INVENTION

In an exemplary embodiment, a method to form a metal matrix composite reinforced with eggshell (ES) is described. The method includes blending and milling a powder mixture which comprises at least one metal powder and an ES powder using a milling machine, compacting the powder mixture in a press to form a compacted powder mixture, and sintering the compacted powder mixture to form a composite matrix. The metal powder comprises at least one magnesium powder and at least one zirconium powder. In some embodiments, Mg powder has a particle size in a range of 20 to 70 micrometers (μm). In some embodiments, Zr powder has a particle size in a range of 20 to 60 μm. The composite matrix comprises magnesium, zirconium, and ES after sintering the compacted powder mixture. An amount of magnesium in the composite matrix is from 89.9 to 99.9 wt. %, an amount of zirconium in the composite matrix is from 0.1 to 10 wt. %, and an amount of ES in the composite matrix is from 0.1 to 10 wt. %. In some embodiments, an amount of the magnesium is from 95 wt. % to 99 wt. % of the composite matrix, an amount of the zirconium is from 0.5 wt. % to 2 wt. % of the composite matrix, and an amount of the ES is from 1 wt. % to 4 wt. % of the composite matrix. In a more preferred embodiment, an amount of magnesium in the composite matrix is from 95 to 97 wt. %, an amount of zirconium in the composite matrix is from 1 to 2 wt. %, and an amount of ES in the composite matrix is from 2 to 3 wt. %.

In some embodiments, the method comprises heating, drying and crushing the eggshell (ES) to form a crushed ES. In some embodiments, the method further comprises grinding the crushed ES to form the ES powder with a reduced particle size.

In some embodiments, the crushed ES has a flake-like morphology after the milling.

In some embodiments, the crushed ES flakes have a length in a range of 10 to 100 μm.

In some embodiments, the crushed ES flakes have a width in a range of 5 to 50 μm.

In some embodiments, the ES powder has an irregular size and shape.

In some embodiments. the ES powder has a particle size in a range of 1 to 10 μm.

In some embodiments, the crushed ES has a broad and intense peak in a range of 2 theta (θ) value 25 to 35° in an X-ray diffraction (XRD) spectrum.

In some embodiments, the ES powder has an intense peak in a range of 2 theta (θ) value 28 to 32° in the XRD spectrum.

In some embodiments, the composite matrix has a density of from 1.7 to 2.0 g/cm$^3$.

In some embodiments, the composite matrix has a microhardness of from 30 to 80 vickers pyramid number (HV).

In some embodiments, zirconium and ES are uniformly distributed throughout the composite matrix.

In some embodiments, the composite matrix has a densification of from 90 to 100% after the sintering of the compacted powder mixture. In some embodiments, the composite matrix has a densification of from 98 to 99.9%

In some embodiments, the milling of the powder mixture occurs at a speed of from 175 to 225 rotations per minute (rpm); wherein the compacting of the powder mixture occurs at a pressure of from 300 to 800 megapascal (MPa); and wherein the sintering of the compacted powder mixture occurs at a temperature of from 300 to 600 degrees Celsius (° C.).

In some embodiments, a Mg—Zr-ES metal matrix composite prepared by the method described has an amount of magnesium from 95 to 97 wt. %, an amount of zirconium from 1 to 2 wt. %, and an amount of ES from 1 to 4 wt. %.

In some embodiments, Zr and ES are uniformly distributed throughout the Mg—Zr-ES metal matrix composite.

In some embodiments, the Mg—Zr-ES metal matrix has a densification of from 98.5% to 99.5% after the sintering of the compacted powder.

In some embodiments, the Mg—Zr-ES metal matrix composite has a first intense peak in a range of 2θ value 32 to 36° in the XRD spectrum, and a second intense peak in a range of 2θ value 34 to 38° in the XRD spectrum.

In some embodiments, the Mg—Zr-ES metal matrix composite has a density of from 1.7 to 1.8 g/cm$^3$.

In some embodiments, the Mg—Zr-ES metal matrix composite has a porosity of from 0.5% to 1%.

In some embodiments, the Mg—Zr-ES metal matrix composite has a microhardness of from 50 to 60 HV. In some embodiments, the Mg—Zr-ES metal matrix composite has a corrosion potential ($E_{corr}$) value of from −1.7 to −1.4 voltage (V).

In some embodiments, the Mg—Zr-ES metal matrix composite has a current density ($I_{corr}$) value of from 20 to 280 microampere per square centimeter ($\mu A/cm^2$).

The foregoing general description of the illustrative present disclosure and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
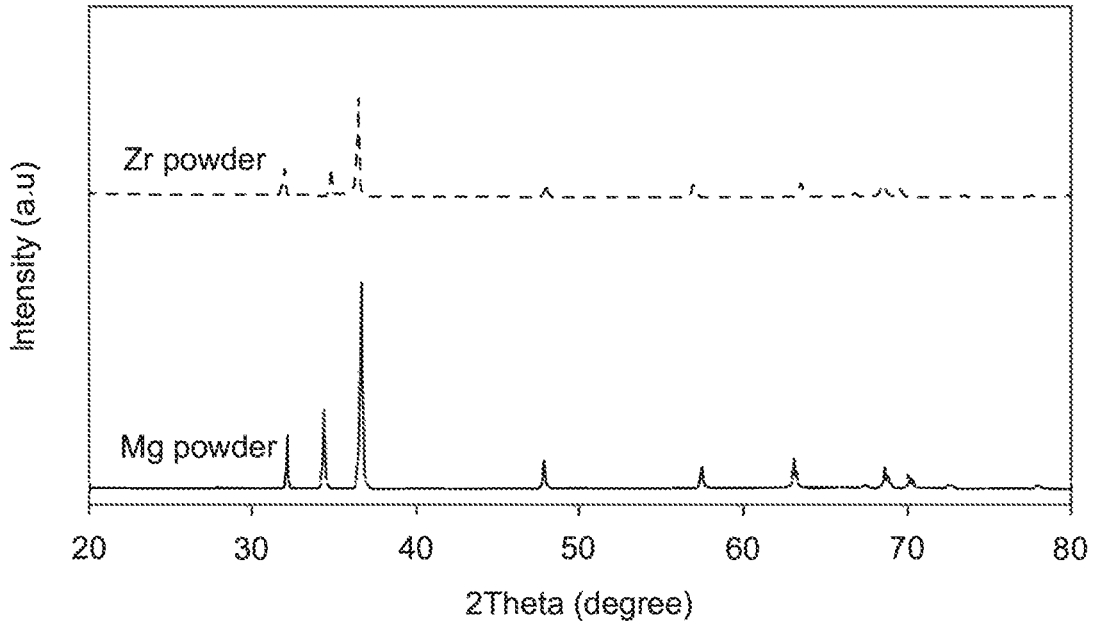
FIG. 1 shows an XRD pattern of magnesium powder and zirconium powder, according to certain embodiments.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values there between.

As used herein, the term "composite" refers to a material formed by at least two components with significantly different physical or chemical properties, when combined, produces a material with characteristics different from the individual components, wherein one of the components is a matrix in an amount typically in a range of about 50% to about 99.9% of the total weight of the composite.

As used herein, the term "metal matrix" refers to an interconnected or continuous network comprising at least one metal. The metal matrix may comprise a single metal, metal alloy, and/or an intermetallic.

As used herein, the terms "metal matrix composite", "metal composite matrix", and "composite matrix" are used interchangeably and are intended to refer to a composite of a metal matrix.

As used herein, the terms "eggshell", "eggshell material", "ES material", and "ES" are used interchangeably and are intended to refer to an outer covering of a hard-shelled egg, and of some forms of eggs with soft outer coats.

As used herein, the term "mixture" refers to a composition comprising at least two chemical constituents, such as two chemical compounds, or a chemical compound, and a chemical element. The constituents of the mixture may be more or less homogeneously distributed.

As used herein, the term "powder" refers to a solid composed of a large number of fine particles that may flow freely when shaken or tilted. The particles may have varied morphology which include one-dimensional (fibers, tubes, and the like), two-dimensional (platelets, films, laminates, planar, and the like), and three-dimensional (spheres, cones, ovals, cylindrical, cubes, monoclinic, parallelepipeds, dumbbells, hexagonal, truncated dodecahedron, irregular shaped structures, and the like) morphology.

As used herein, the term "metal powder" refers to powder of pure metal, alloy, intermetallic compound, and mixtures thereof. The term includes powder of metallic primary particles, aggregates, agglomerates, other discrete metal particles, or any combination thereof. Further, the term includes single metal, multi-metal, and complex compositions.

As used herein, the term "ES powder", and "eggshell powder" are used interchangeably and are intended to refer to powder of the eggshell.

As used herein, the term "sinter" refers to making a powdered material coalesce into a solid or porous mass by heating it without complete liquefaction.

As used herein, the term "full density" refers to a density greater than 95% of theoretical density.

As used herein, the term "compact" refers to an intermediate product form that has not been compressed to full density. A compact may be an axisymmetric billet shape or near-net shape or any other shape advantageous to downstream processing.

As used herein, the term "phase" refers to (as in thermodynamics) a homogeneous volume of matter.

As used herein, the term "heating" refers to any thermal treatment at or to a desired heating temperature.

As used herein, the term "drying", refers to any process of removing a significant portion of water.

As used herein, the term "milling" when used in relation to milling a plurality of particles in addition to a conventional milling machine operation, refers to any process in which particles and any optional additives are mixed to achieve a substantially uniform mixture.

As used herein, the term "grinding", refers to any process of reducing the size of something by crushing it.

As used herein, the term "compacting" refers to any process of applying pressure on the mixture to obtain a preferred geometry.

As used herein, the term "metal" refers to essentially pure metal, or a commercially available metal having impurities and/or alloying constituents therein.

As used herein, the term "magnesium", and "Mg" are used interchangeably and are intended to refer to magnesium metal.

As used herein, the term "zirconium", and "Zr" are used interchangeably and are intended to refer to zirconium metal.

Aspects of the present disclosure are directed towards a method to form a metal matrix composite reinforced with an eggshell (ES), for example, a method to form a Mg—Zr-ES metal matrix composite. The formed Mg—Zr-ES metal matrix composite has a homogeneous distribution of reinforcement, shows enhanced microhardness and improved in vitro corrosion properties, which opens the door for exploring the green and low-cost ES reinforced materials for biomedical applications. The structure, microstructure, densification, microhardness and in vitro corrosion characteristics of the resultant Mg—Zr-ES metal composite are also analyzed using different analytical techniques.

In one embodiment, the method includes blending and milling at least one metal powder and at least one ES powder to form a powder mixture, compacting the powder mixture in a press to form a compacted powder mixture, and sintering the compacted powder mixture to form a composite matrix. In yet another embodiment, the step of forming the powder mixture comprises blending at least one metal powder and at least one ES powder to provide a blended powder and mixing the blended powder by using the milling machine.

In another embodiments, the metal powder comprises at least one magnesium (Mg) powder and at least one zirconium (Zr) powder. In some embodiments, the Mg powder has a particle size in a range of 20 to 70 micrometers (μm), preferably 30 to 60 μm, more preferably 40 to 50 μm. In some embodiments, the Zr powder has a particle size in a range of 20 to 60 micrometers (μm), preferably 30 to 50 μm, more preferably 40 to 50 μm. Other ranges are also possible.

In an exemplary embodiment, the metal composite matrix comprises magnesium and zirconium. In another exemplary embodiment, the metal composite matrix comprises magnesium and ES. In yet another exemplary embodiment, the composite matrix comprises magnesium, zirconium, and ES.

In one embodiment, the metal composite matrix comprises magnesium and zirconium, wherein an amount of magnesium in the composite matrix is from 95 to 99.9 wt. %, an amount of zirconium in the composite matrix is from 0.1 to 5.0 wt. %. In another embodiment, the metal composite matrix comprises magnesium and zirconium, wherein an amount of magnesium in the composite matrix is from 97 to 99.5 wt. %, an amount of zirconium in the composite matrix is from 0.5 to 3.0 wt. %. In a further preferred embodiment, the metal composite matrix comprises magnesium and zirconium, wherein an amount of magnesium in the composite matrix is from 98.5 to 99.5 wt. %, an amount of zirconium in the composite matrix is from 0.5 to 1.5 wt. %. Other ranges are also possible.

In one embodiment, the metal composite matrix comprises magnesium and ES, wherein an amount of magnesium in the composite matrix is from 90 to 99.9 wt. %, an amount of ES in the composite matrix is from 0.1 to 10 wt. %. In another embodiment, the metal composite matrix comprises magnesium and ES, wherein an amount of magnesium in the composite matrix is from 95 to 99 wt. %, an amount of ES in the composite matrix is from 1.0 to 5.0 wt. %. In a further preferred embodiment, the metal composite matrix comprises magnesium and ES, wherein an amount of magnesium in the composite matrix is from 97 to 98 wt. %, an amount of ES in the composite matrix is from 1 to 4 wt. %. Other ranges are also possible.

In yet another embodiment, the composite matrix comprises magnesium, zirconium, and ES, wherein an amount of magnesium in the composite matrix is from 89.9 to 99.9 wt. %, and an amount of zirconium in the composite matrix is from 0.1 to 10 wt. %, and an amount of ES in the composite matrix is from 0.1 to 10 wt. %. In a further preferred embodiment, the composite matrix comprises magnesium, zirconium, and ES, wherein an amount of magnesium in the composite matrix is from 95 to 99 wt. %, an amount of zirconium in the composite matrix is from 0.5 to 2 wt. %, and an amount of ES in the composite matrix is from 0.5 to 5 wt. %. In a more preferred embodiment, the composite matrix comprises magnesium, zirconium, and ES, wherein an amount of magnesium in the composite matrix is from 95 to 97 wt. %, an amount of zirconium in the composite matrix is from 1 to 2 wt. %, and an amount of ES in the composite matrix is from 1 to 4 wt. %. Other ranges are also possible.

In an embodiment, the method comprises a step of preparing the ES powder. In another embodiment, the step of preparing the ES powder comprises heating, drying, and crushing the eggshell to from a crushed ES. In yet another embodiment, the step of preparing the ES powder comprises grinding the crushed ES to form the ES powder, wherein the ES powder has a reduced particle size. In an exemplary embodiment, the step of preparing the ES powder comprises heating the ES material in boiling water. In yet another embodiment, the step of preparing the ES powder comprises drying the heated ES material to provide a dried ES material. In yet another embodiment, the step of preparing the ES powder comprises crushing the dried ES material to form a crushed ES. In yet another embodiment, the step of preparing the ES powder comprises grinding the crushed ES to form the ES powder.

In yet another embodiment, the ES material is crushed before heating, drying, or grinding steps to provide a crushed ES material.

In certain embodiments, the crushed ES has a flake-like morphology. In some embodiments, the crushed flakes have a length in a range of 1 to 500 μm, preferably 5 to 300 μm, more preferably 10 to 200 μm, and even more preferably 10 to 100 μm. In some embodiments, the crushed flakes have a width in a range of 1 to 300 μm, preferably 5 to 200 μm, more preferably 5 to 100 μm, and even more preferably 5 to 50 μm. Other ranges are also possible.

In an embodiment, the ES powder has one-dimensional morphology, two-dimensional morphology, three-dimensional morphology, and any combination thereof. In another embodiment, the ES powder has one-dimensional morphology including but not limited to fibers, and tubes. In yet another embodiment, the ES powder has two-dimensional morphology including but not limited to platelets, films, laminates, planar, and flakes. In yet another embodiment, the ES powder has three-dimensional morphology including but not limited to spheres, cones, ovals, cylindrical, cubes, monoclinic, parallelepipeds, dumbbells, hexagonal, truncated dodecahedron, and irregular shaped structures. In an exemplary embodiment, the ES powder has an irregular size and shape. In certain embodiments, the ES powder has a particle size in a range of 0.1 to 100 μm, preferably 0.5 to 50 μm, more preferably 1 to 25 μm, and even more preferably 1 to 10 μm. Other ranges are also possible.

Figure 2:
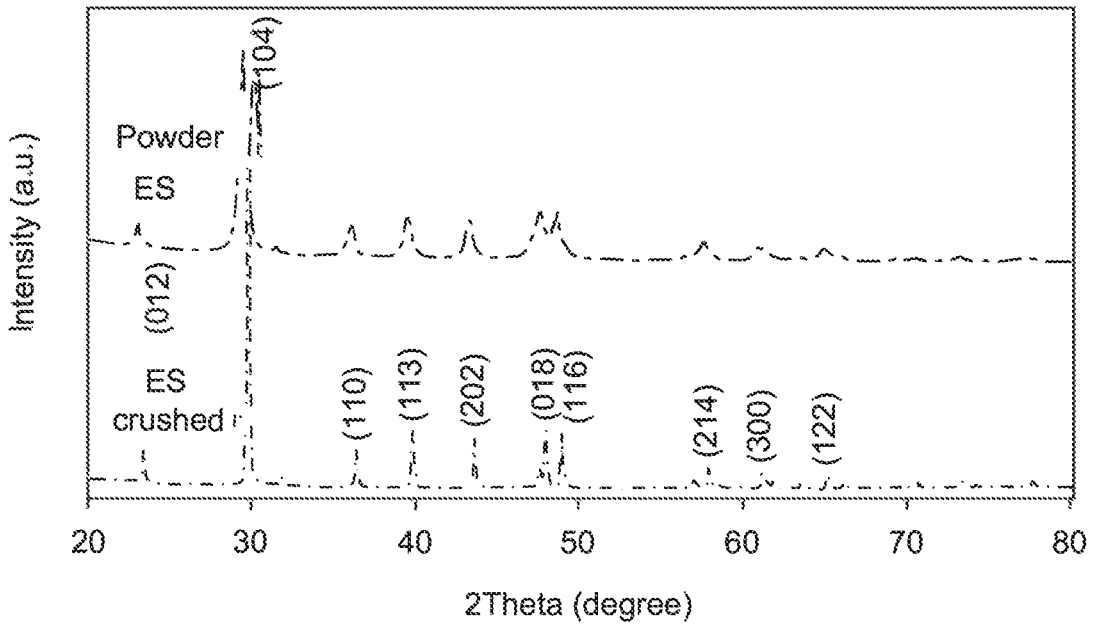
FIG. 2 shows an XRD pattern of crushed ES and ES powder, according to certain embodiments.

In some embodiments, the crushed ES has a broad and intense peak in a range of 2 theta (θ) value 25 to 35°, 27 to 33°, 29 to 31° in an X-ray diffraction (XRD) spectrumas illustrated in FIG. 2. In some embodiments, the ES powder has an intense peak in a range of 2θ value 28 to 32°, 29 to 31° in the XRD spectrum as illustrated in FIG. 2. The change of peak intensity and shape in the XRD spectrum as depicted in FIG. 2, indicates a decrease of ES crystallite size and particle size refinement.

The density of the composite matrix is determined following ASTM B962-17 standards. The composite matrix prepared by the method disclosed provides a near-dense material. In some embodiments, the composite matrix has a density of from 1.7 to 2.0 g/cm$^3$, preferably from 1.7 to 1.8 g/cm$^3$. In some embodiments, the composite matrix has a densification of from 90 and 100%, preferably from 98 to 99.9%. Other ranges are also possible.

Microhardness is determined using the HV test following ASTM E384-08, which measures the hardness of materials with low applied loads. In some embodiments, the composite matrix has a microhardness of from 30 to 80 vickers pyramid number (HV), preferably from 40 to 70 HV, and more preferably from 50 to 60 HV. Other ranges are possible.

In an embodiment, the zirconium and ES particles are uniformly distributed throughout the composite matrix.

The method to form the metal matrix composite includes the step of milling the powder mixture. In an embodiment, the milling of the powder mixture occurs at a speed in a range of about 150 to about 250 rotations per minute (rpm), preferably in a range of about 175 to about 225 rpm. In another embodiment, the milling of the powder mixture occurs at the speed in the range of about 175 to about 225 rpm. In an exemplary embodiment, the milling of the powder mixture occurs at the speed of about 200 rpm. Other ranges are possible.

The method to form the metal matrix composite includes the step of compacting the powder mixture. In an embodiment, the compacting of the powder mixture occurs at a pressure of from 300 to 800 megapascal (MPa). In another embodiment, the compacting of the powder mixture occurs at a pressure of from 400 to 700 MPa. In a more preferred embodiment, the compacting of the powder mixture occurs at a pressure of from 500 to 600 MPa. Other ranges are also possible.

The method to form the metal matrix composite includes the step of sintering the compacted powder mixture. In an embodiment, the sintering of the compacted powder mixture occurs at a temperature of from 300 to 600 degrees Celsius (° C.). In another embodiment, the sintering of the compacted powder mixture occurs at a temperature of from 400 to 500° C. In a more preferred embodiment, the sintering of the compacted powder mixture occurs at a temperature of about 450° C. Other ranges are also possible.

In an embodiment, an Mg—Zr-ES metal matrix composite is disclosed.

In another embodiment, the Mg—Zr-ES metal matrix composite prepared by the method is disclosed.

In one embodiment, the Mg—Zr-ES metal matrix composite has an amount of magnesium from 95 to 97 wt. %, an amount of zirconium from 1 to 2 wt. %, and an amount of ES from 1 to 4 wt. %. In another embodiment, the Mg—Zr-ES metal matrix has an amount of magnesium from 96 to 97 wt. %, an amount of zirconium from 1 to 2 wt. %, and an amount of ES from 2 to 3 wt. %.

In some embodiments, the Mg—Zr-ES metal matrix composite is prepared by the method, wherein the method includes preparing an Mg—Zr-ES powder mixture which comprises the magnesium powder, the zirconium powder and the ES powder using the milling machine, compacting the Mg—Zr-ES powder mixture in the press to form a compacted Mg—Zr-ES powder mixture, and sintering the Mg—Zr-ES compacted powder mixture to form the Mg—Zr-ES composite matrix.

In yet another embodiment, the Mg—Zr-ES metal matrix composite prepared by the method is disclosed, wherein the metal composite matrix has the amount of magnesium from 95 to 97 wt. %, an amount of zirconium from 1 to 2 wt. %, and an amount of ES from 1 to 4 wt. %. In yet another embodiment, the Mg—Zr-ES metal matrix composite prepared by the method, wherein the metal composite matrix has an amount of magnesium from 96 to 97 wt. %, an amount of zirconium from 1 to 2 wt. %, and an amount of ES from 2 to 3 wt. %.

In certain embodiments, Zr and ES are uniformly distributed throughout the Mg—Zr-ES metal matrix composite.

In certain embodiments, the Mg—Zr-ES metal matrix has a densification of from 97 to 99.9% after the sintering of the compacted powder. In some embodiments, the Mg—Zr-ES metal matrix has a densification of from 98 to 99.5% after the sintering of the compacted powder. In some embodiments, the Mg—Zr-ES metal matrix has a densification of from 98.5 to 99.5% after the sintering of the compacted powder.

In certain embodiments, the Mg—Zr-ES metal matrix composite has a first intense peak in a range of 2θ value 32 to 36° in the XRD spectrum, and a second intense peak in a range of 2θ value 34 to 38" in the XRD spectrum. In some embodiments, the Mg—Zr-ES metal matrix composite has a first intense peak in a range of 2θ value 32 to 34° in the XRD spectrum, and a second intense peak in a range of 2θ value 36 to 38° in the XRD spectrum. Other ranges are also possible.

In certain embodiments, the Mg—Zr-ES metal matrix composite has a density of from 1.7 g/cm$^3$ to 1.8 g/cm$^3$. In some embodiments, the Mg—Zr-ES metal matrix composite has a density of from 1.72 g/cm$^3$ to 1.78 g/cm$^3$. In some embodiments, the Mg—Zr-ES metal matrix composite has a density of from 1.74 g/cm$^3$ to 1.76 g/cm$^3$. Other ranges are also possible.

In certain embodiments, the Mg—Zr-ES metal matrix composite has a porosity of from 0.5 to 1%, preferably from 0.6 to 0.9%, and more preferably from 0.7 to 0.8%. Other ranges are also possible.

In certain embodiments, the Mg—Zr-ES metal matrix composite has a microhardness of from 40 to 70 HV, further preferably from 45 to 65 HV, more preferably from 50 to 60 HV, and even more preferably from 50 to 55 HV. Other ranges are also possible.

Figure 8:
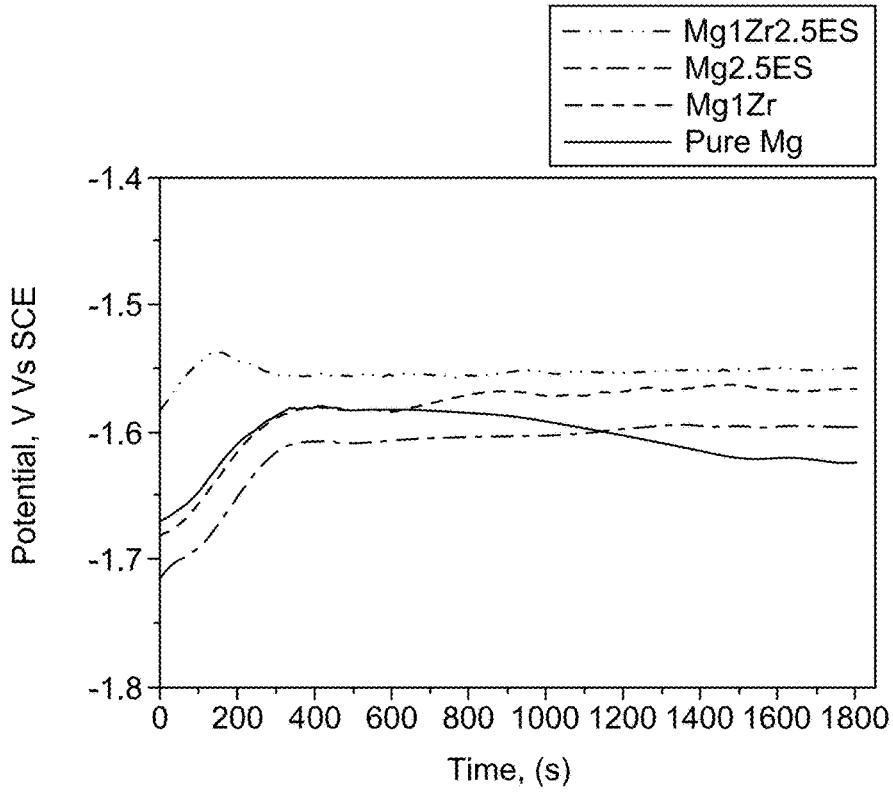
FIG. 8 shows OCP curves of materials in Hank's medium, according to certain embodiments.

Corrosion performance of the metal matrix composite is conducted in a physiological environment to simulate the performance of the material in biomedical applications. In some embodiments, the Mg—Zr-ES metal matrix composite prepared by the disclosed method has an open circuit voltage (OCP) value of from −1.7 to −1.4 V, preferably from −1.6 to −1.5 V, and more preferably from −1.55 to −1.5 V. In some embodiments, time to achieve a stable OCP value as depicted in FIG. 8 is at least 1 minutes, at least 5 minutes, at least 10 minutes, or at least 15 minutes. In some embodiments, time to achieve a stable OCP value as depicted in FIG. 8 is less than or equal to 20 minutes, less than or equal to 15 minutes, less than or equal to 10 minutes, or less than or equal to 5 minutes. Other ranges are also possible.

Figure 9:
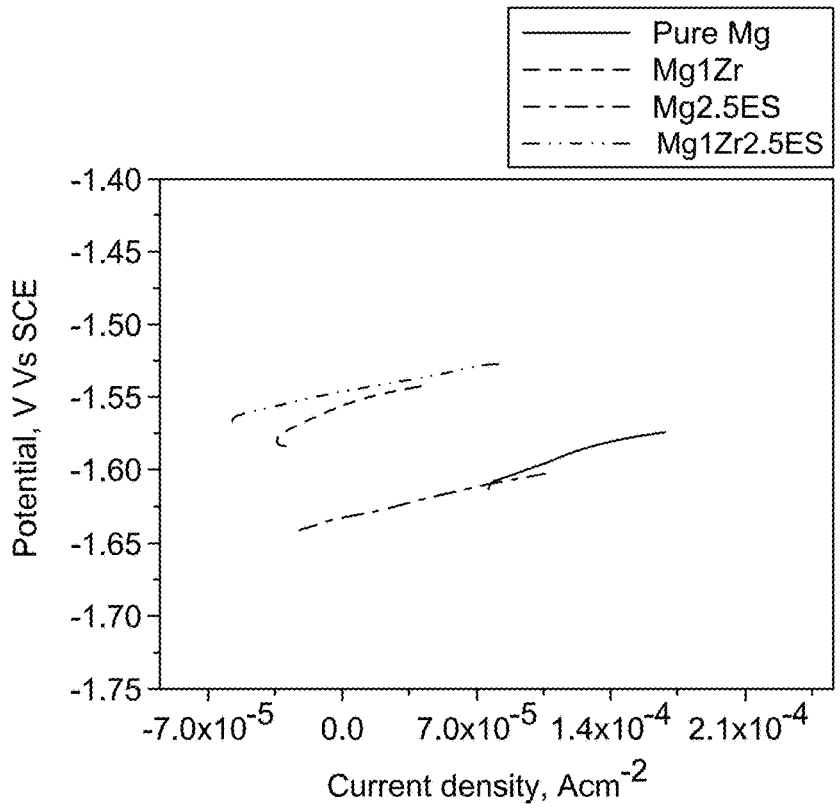
FIG. 9 shows LPR curves of materials in Hank's medium, according to certain embodiments.

Referring to FIG. 9, linear polarization resistance (LPR) curve of the metal matrix composite is illustrated. In some embodiments, the Mg—Zr-ES metal matrix composite has a corrosion potential ($E_{corr}$) value of from −1.7 to −1.4 V, preferably from −1.6 to −1.5 V, and more preferably from −1.55 to −1.5 V. In some embodiments, the Mg—Zr-ES metal matrix composite has a current density ($I_{corr}$) value of from 1 to 100 microampere per square centimeter ($\mu A/cm^2$), preferably from 5 to 50 $\mu A/cm^2$, and more preferably from 10 to 15 $\mu A/cm^2$. Polarization resistance (Rp), which corresponds to corrosion resistance, is also obtained from the LPR curve as depicted in FIG. 9. In some embodiments, the Mg—Zr-ES metal matrix composite has a Rp value of from 50 to 2000 ohm square centimeter ($\Omega \cdot cm^2$), preferably from 500 to 1700 $\Omega \cdot cm^2$, and more preferably from 1300 to 1500 $\Omega \cdot cm^2$. Other ranges are also possible.

Figure 10:
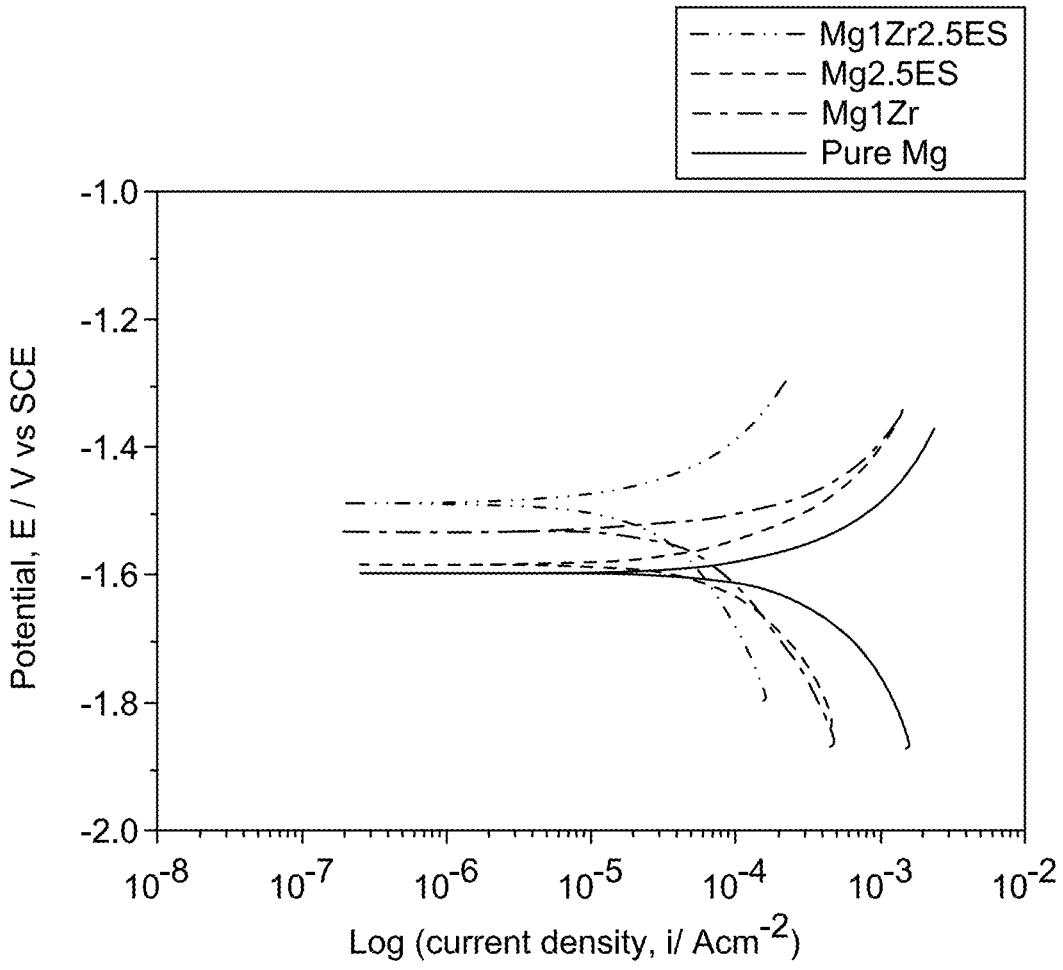
FIG. 10 shows PDP curves of materials in Hank's medium, according to certain embodiments.

Referring to FIG. 10, potentiodynamic polarization (PDP) curve of the metal matrix composite is illustrated. A positive synergetic effect is observed in the Mg—Zr-ES composite. On one hand, pure Mg shows the most negative $E_{corr}$ and highest $I_{corr}$ value as depicted in FIG. 10, indicating that pure Mg has the lowest corrosion-resistant behavior. On the other hand, the Mg—Zr-ES composite exhibits most positive $E_{corr}$ and lowest $I_{corr}$ value as depicted in FIG. 10, revealing that the Mg—Zr-ES shows improved corrosion protection performance. The positive synergetic effect of reinforcing the Zr and ES particles into the Mg matrix is further corroborated by comparing the corrosion rate of pure Mg and the Mg—Zr-ES composite using Tafel extrapolation. The estimated corrosion rate for the Mg—Zr-Es is lower than the pure Mg in Hank's medium. In some embodiments, the Mg—Zr-ES metal matrix composite has the $E_{corr}$ value of from −1.7 to −1.4 V, preferably from −1.6 to −1.5 V, and more preferably from −1.55 to −1.5 V. In some embodiments, the Mg—Zr-ES metal matrix composite has the $I_{corr}$ value of from 10 to 300 $\mu A/cm^2$, preferably from 15 to 100 $\mu A/cm^2$, and more preferably from 20 to 30 $\mu A/cm^2$. In some embodiments, the Mg—Zr-ES metal matrix composite has a corrosion rate of from 0.5 to 20 millimeter per year (mm/yr), preferably from 1 to 10 mm/yr, and more preferably from 1 to 5 mm/yr. Other ranges are also possible.

Figure 12:
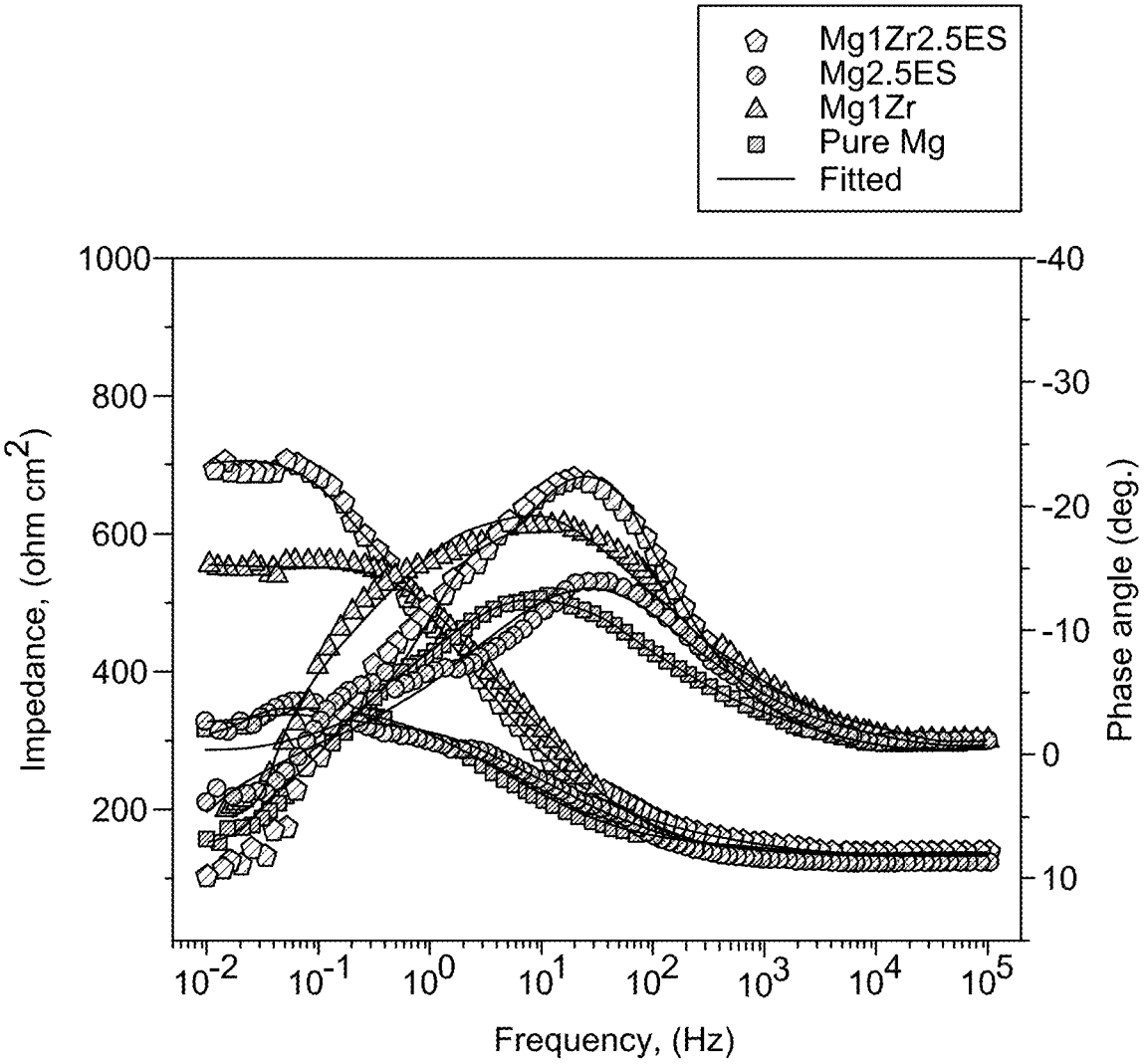
FIG. 12 shows Bode curves of materials in Hank's medium, according to certain embodiments.

Referring to FIG. 12, the bode curve of the metal matrix composite is illustrated. In some embodiments, the Mg—Zr-ES metal matrix composite has a solution resistance ($R_s$) value of from 80 to 120 $\Omega \cdot cm^2$, preferable from 90 to 110 $\Omega \cdot cm^2$, and more preferably from 95 to 105 $\Omega \cdot cm^2$. In some embodiments, the Mg—Zr-ES metal matrix composite has a charge transfer resistance ($R_{ct}$) value of from 100 to 1000 $\Omega \cdot cm^2$, preferable from 300 to 900 $\Omega \cdot cm^2$, and more preferably from 600 to 800 $\Omega \cdot cm^2$. Other ranges are possible.

In an embodiment the composite prepared by the method can be used for biomedical applications including but not limited to bone fixation, orthopedic application such as screws and plates.

EXAMPLES

The following examples describe and demonstrate exemplary embodiments of the method to form metal matrix composite reinforced with eggshell described herein. The examples are provided solely for illustration and are not to be construed as limitations of the present disclosure, as many variations thereof are possible without departing from the spirit and scope of the present disclosure.

Example 1: Preparation of the ES Powder

ES was collected locally and heated for 10 minutes in boiling water, followed by drying at 200° C. for 10 minutes to provide the dried ES. The dried ES was milled in a ball mill under argon atmosphere at 250 rpm using WC vials and WC balls in a planetary Micro Mill PULVERISETTE 7 premium line (FRITSCH, Germany) at ball-to-powder-ratio (BPR) of 10:1 for 20 hours to obtain the ES powder.

Example 2: Preparation of the Metal Matrix Composite and Control Samples

Magnesium powder (99.8 percent purity with an average particle size of 45 m) and Zirconium powder (−325 mesh size and 99.8% purity) used for the preparation of the metal matrix composite was supplied by Alfa Aeser.

Example 2a: Preparation of the Mg-2.5ES Composite

Mg-2.5ES (wt. %) powders were blended to provide the blended Mg-2.5ES powder. The blended Mg-2.5ES powder was then loaded into WC vials in a planetary Micro Mill PULVERISETTE 7 premium line (FRITSCH, Germany) and mixed for 2 hours at 200 rpm under an argon atmosphere to provide the Mg-2.5ES powder mixture. The Mg-2.5ES powder mixture was then compacted in a uniaxial press at 550 MPa and held for 5 minutes in tool steel die with a bore diameter of 20 mm to provide the compacted Mg-2.5ES powder mixture. The compacted Mg-2.5ES powder mixture was sintered in a tube furnace (GSL-1700X, MTI) at 450° C. for 2 hours under an argon atmosphere using a heating rate of 10° C./minute to provide the Mg-2.5ES composite.

Example 2b: Preparation of the Mg-1Zr-2.5ES Composite

Mg-1Zr-2.5ES (wt. %) powders were blended to provide the blended Mg-1Zr-2.5ES powder. The blended Mg-1Zr-2.5ES powder was then loaded into WC vials in a planetary Micro Mill PULVERISETTE 7 premium line (FRITSCH, Germany) and mixed for 2 hours at 200 rpm under an argon atmosphere to provide the Mg-1Zr-2.5ES powder mixture. The Mg-1Zr-2.5ES powder mixture was then compacted in a uniaxial press at 550 MPa and held for 5 minutes in tool steel die with a bore diameter of 20 mm to provide the compacted Mg-1Zr-2.5ES powder mixture. The compacted Mg-1Zr-2.5ES powder mixture was sintered in a tube furnace (GSL-1700X, MTI) at 450° C. for 2 hours under an argon atmosphere using a heating rate of 10° C./minute to provide the Mg-1Zr-2.5ES composite.

Control samples of sintered magnesium, zirconium and Mg-1Zr were also prepared for Comparing Properties of the Prepared Metal Matrix Composite.

Example 2c: Preparation of the Sintered Magnesium

Magnesium powder was compacted in a uniaxial press at 550 MPa and held for 5 minutes in tool steel die with a bore diameter of 20 mm to provide compacted magnesium powder. The compacted magnesium powder was sintered in a tube furnace (GSL-1700X, MTI) at 450° C. for 2 hours under an argon atmosphere using a heating rate of 10° C./minute to provide the sintered magnesium.

Example 2d: Preparation of the Sintered Zirconium

Zirconium powder was compacted in a uniaxial press at 550 MPa and held for 5 minutes in tool steel die with a bore diameter of 20 mm to provide compacted zirconium powder. The compacted zirconium powder was sintered in a tube furnace (GSL-1700X, MTI) at 450° C. for 2 hours under an argon atmosphere using a heating rate of 10° C./minute to provide the sintered zirconium.

Example 2e: Preparation of the Sintered Mg-1Zr

Mg-1Zr (wt. %) powders were blended to provide a blended Mg-1Zr powder. The blended Mg-1Zr powder was then loaded into WC vials in a planetary Micro Mill PULVERISETTE 7 premium line (FRITSCH, Germany) and mixed for 2 hours at 200 rpm under an argon atmosphere to provide a Mg-1Zr mixed powder. The Mg-1Zr mixed powder was then compacted in a uniaxial press at 550 MPa and held for 5 minutes in tool steel die with a bore diameter of 20 mm to provide a compacted Mg-1Zr mixed powder. The compacted Mg-1Zr mixed powder was sintered in a tube furnace (GSL-1700X, MTI) at 450° C. for 2 hours under an argon atmosphere using a heating rate of 10° C./minute to provide the sintered Mg-1Zr.

Example 3: Characterization Methods

The prepared materials were characterized in terms of structure, microstructure, densification, and microhardness.

Example 3a: X-Ray Powder Diffraction (XRD) Analysis

The XRD analysis was performed on a Bruker-AXS D8 diffractometer using Cu Kα (λ=1.5418 Å) radiation. The magnesium powder, zirconium powder, crushed ES, ES powder, sintered magnesium, sintered Mg-1Zr, Mg-2.5ES composite, and Mg-1Zr-2.5ES composite samples were scanned with a 0.02° step size and 2θ range of 20° to 90°.

Referring now to FIG. 1, all the peaks are clearly shown in XRD pattern of magnesium and zirconium powders. Magnesium powder's XRD pattern reveals presence of (10-10) prism, (0002) basal, and (10-11) pyramidal planes at 2θ angles of 32°, 34°, and 36°, respectively [Seetharaman et al., Materials 6, 1940-55, 2013; Jayalakshmi et al., J. Alloys Compd. 565, 56-65, 2013].

Referring now to FIG. 2, the XRD pattern of crushed ES, and ES powder revealed no impurity or extra secondary phases. The full width at half maximum of ES powder was increased after milling, indicating a decrease in the crystallite size and particle size refinement.

Figure 3A:
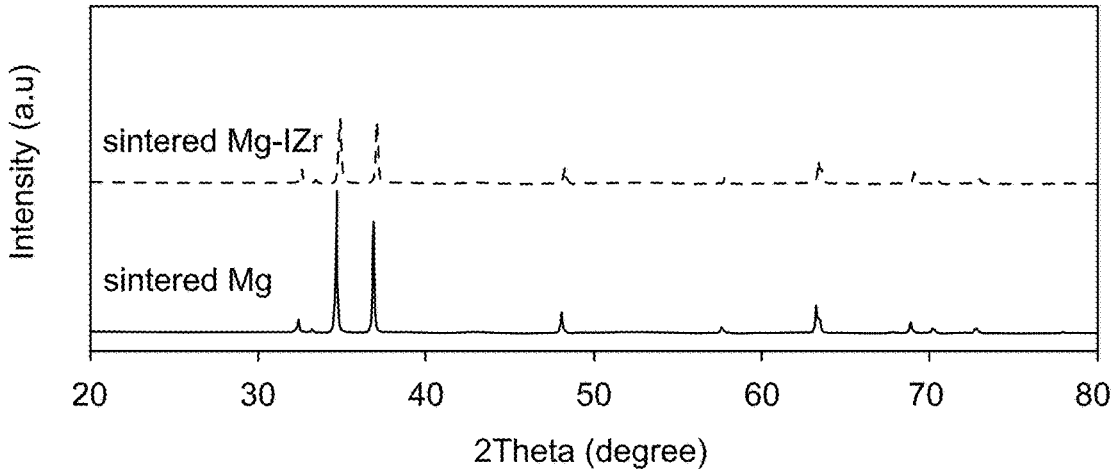
FIG. 3A shows an XRD pattern of sintered magnesium and sintered Mg-1Zr, according to certain embodiments.
Figure 3B:
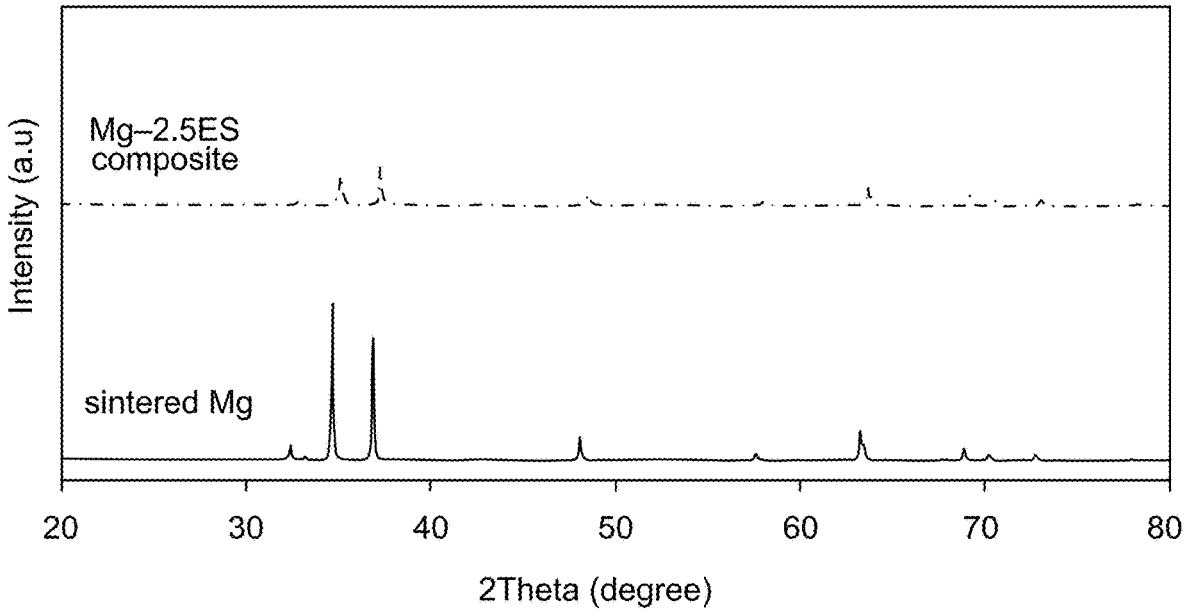
FIG. 3B shows an XRD pattern of sintered magnesium and sintered Mg-2.5ES, according to certain embodiments.
Figure 3C:
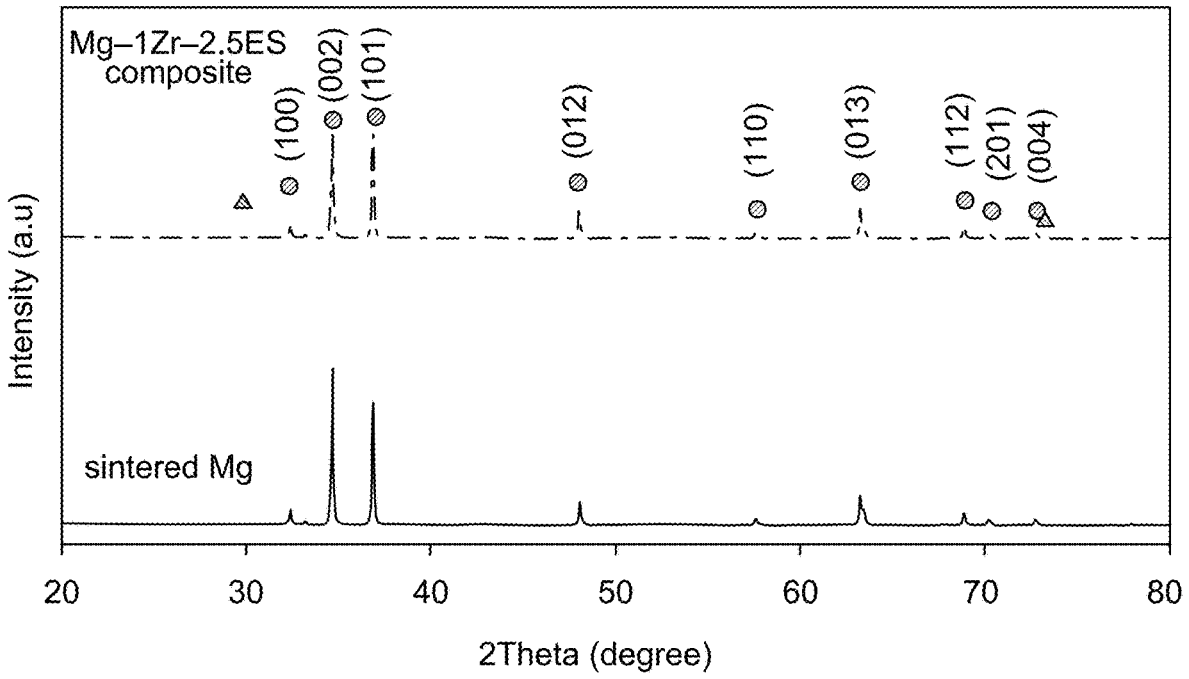
FIG. 3C shows an XRD pattern of sintered magnesium and sintered Mg-1Zr-2.5ES, according to certain embodiments.

Referring now to FIG. 3A-3C, the XRD pattern of Mg-2.5ES composite (FIG. 3B), and Mg-1Zr-2.5ES composite (FIG. 3C) showed no extra peaks, indicating that no additional phases were produced during the sintering process. Magnesium peaks were seen in all samples (i.e. sintered magnesium, sintered Mg-1Zr (FIG. 3A), Mg-2.5ES (FIG. 3B) composite, and Mg-1Zr-2.5E5 composite (FIG. 3C)), however weak ES peaks were observed in Mg-1Zr-2.5ES composite. XRD results also revealed that the texture of the metal matrix composite was altered by presence of zirconium and ES particles. It was reported that reinforcing phases can affect the basal texture of magnesium crystals [Stanford et al., Scr. Mater. 59, 772-5, 2008]. The XRD analysis of magnesium powder (FIG. 1) showed the maximum intensity in the basal plane (0002), indicating a significant basal texture. Additionally, when compared to sintered magnesium powder, it was observed that the peak corresponding to the basal plane (0002) was lowered for Mg-2.5ES composite (FIG. 3B), and Mg-1Zr-2.5ES composite (FIG. 3C), which agrees with a prior finding [Meenashisundaram et al., Mater. Charact. 94, 178-188, 2014].

Example 3b: Field Emission Scanning Electron Microscope (FESEM) and Energy Dispersive X-Ray (EDS) Analysis Microstructural analysis of magnesium powder, zirconium powder, ES powder, and crushed ES was performed on metallographic polished samples under FESEM (FEI Quanta 250 FEG, USA). A distribution of zirconium and ES particles throughout the magnesium matrix in Mg-1Zr-2.5ES powder mixture, Mg-2.5ES powder mixture, Mg-1Zr mixed powder, sintered Mg-1Zr, Mg-1Zr-2.5ES composite, and Mg-2.5ES composite was analyzed by SEM analysis followed by their EDS mapping.

Microstructural examination revealed no indication of micro flaws following compaction and sintering. Additionally, the outer surfaces were smooth and fracture-free circumferentially.

Figure 4A:
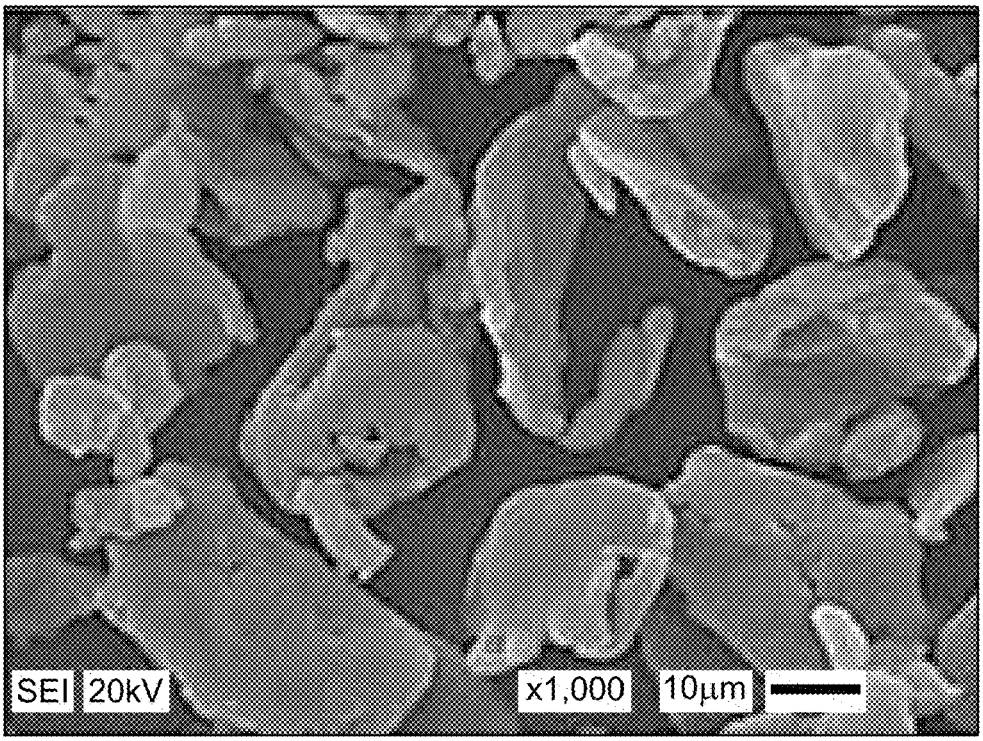
FIG. 4A shows an SEM micrograph of magnesium powder, according to certain embodiments.
Figure 4B:
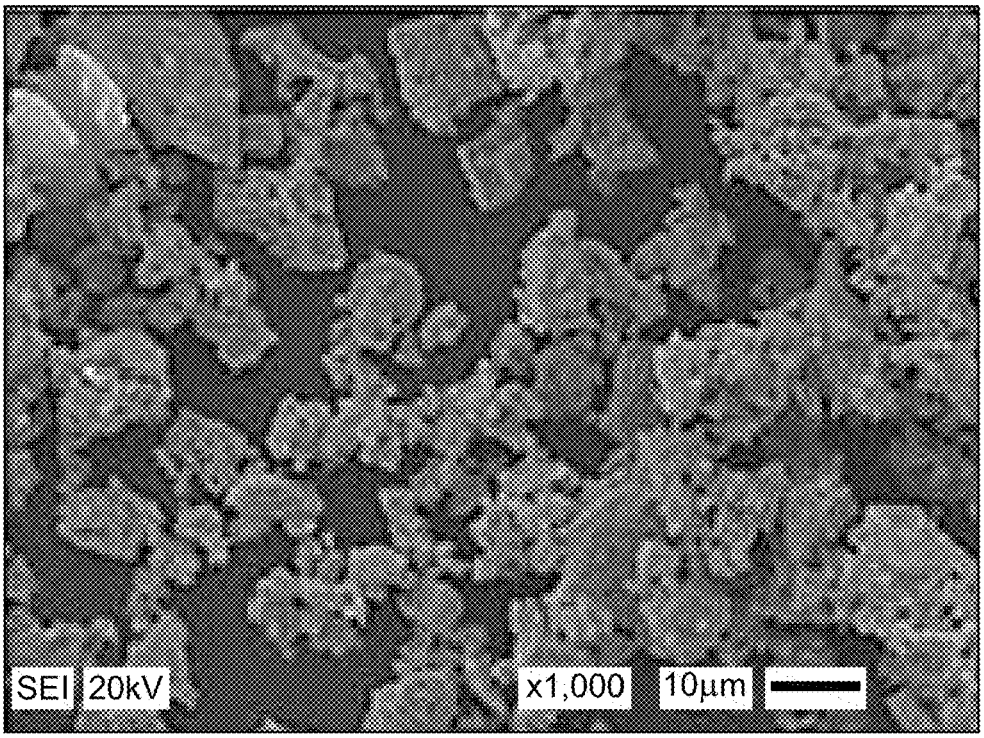
FIG. 4B shows an SEM micrograph of zirconium powder, according to certain embodiments.
Figure 4C:
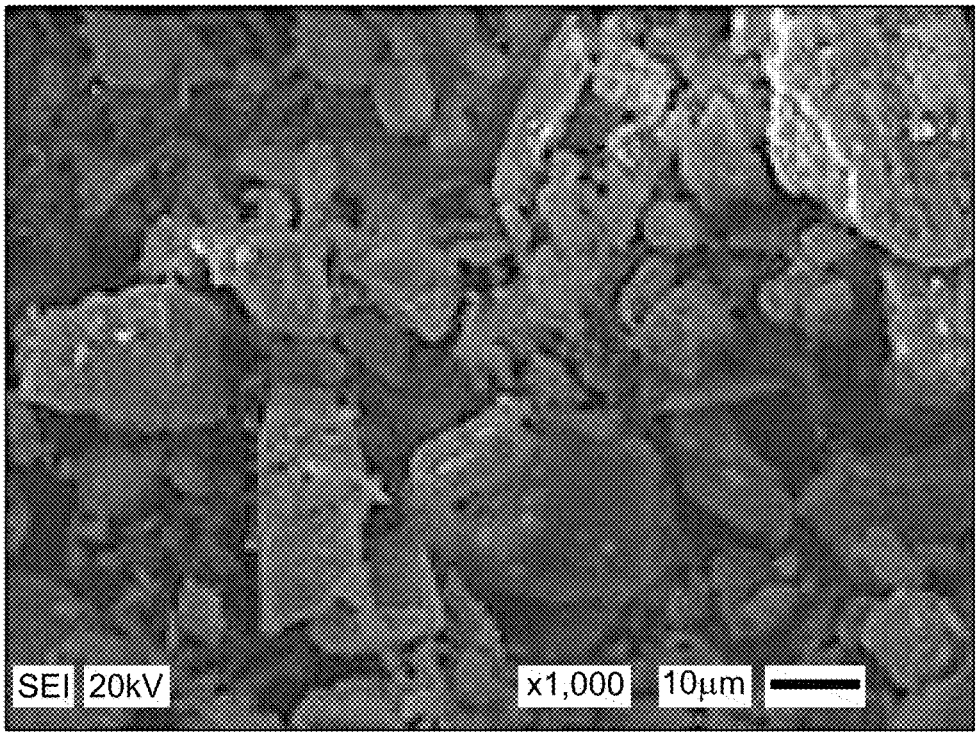
FIG. 4C shows an SEM micrograph of crushed ES, according to certain embodiments.
Figure 4D:
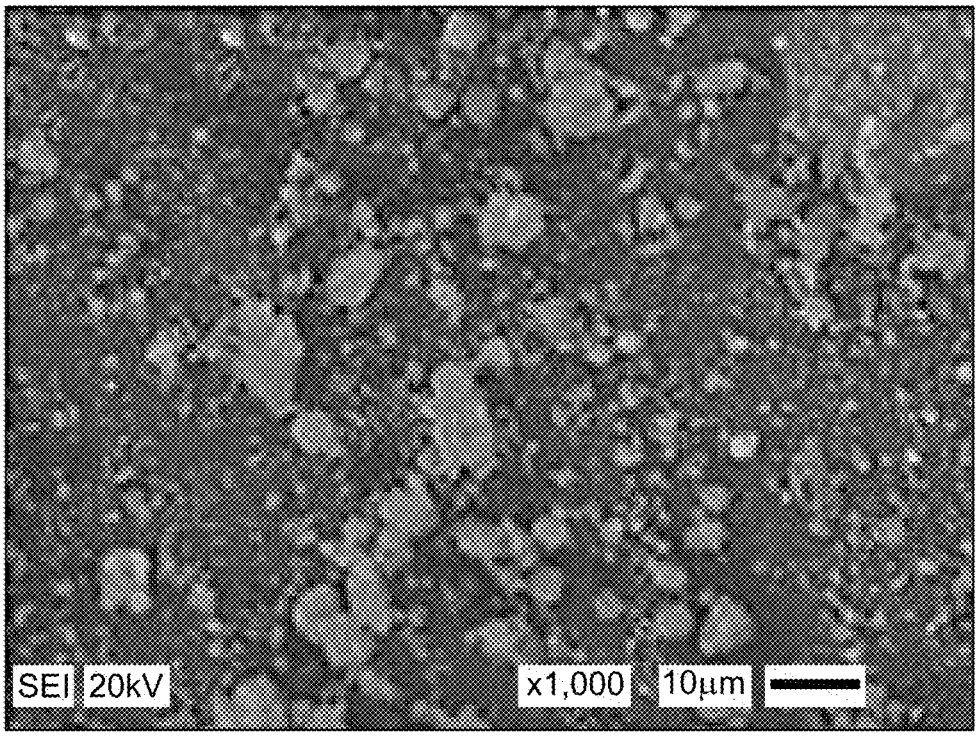
FIG. 4D shows an SEM micrograph of ES powder, according to certain embodiments.

Referring now to FIG. 4A-4D, the SEM micrographs depict morphology of magnesium powder (FIG. 4A), zirconium powder (FIG. 4B), crushed ES (FIG. 4C), and ES powder (FIG. 4D).

Figure 5A:
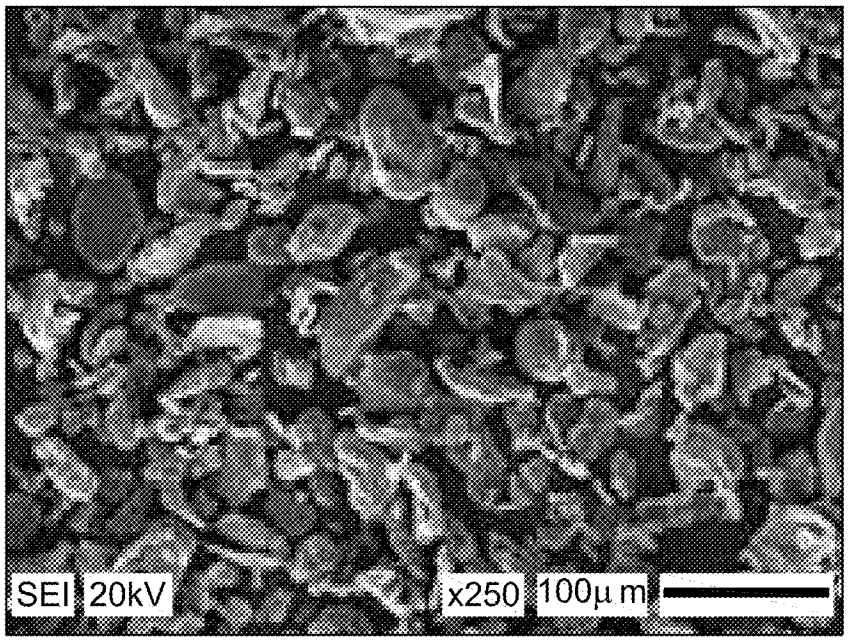
FIG. 5A shows an SEM image, and corresponding elemental map of the Mg-2.5ES powder mixture, according to certain embodiments.
Figure 5A:
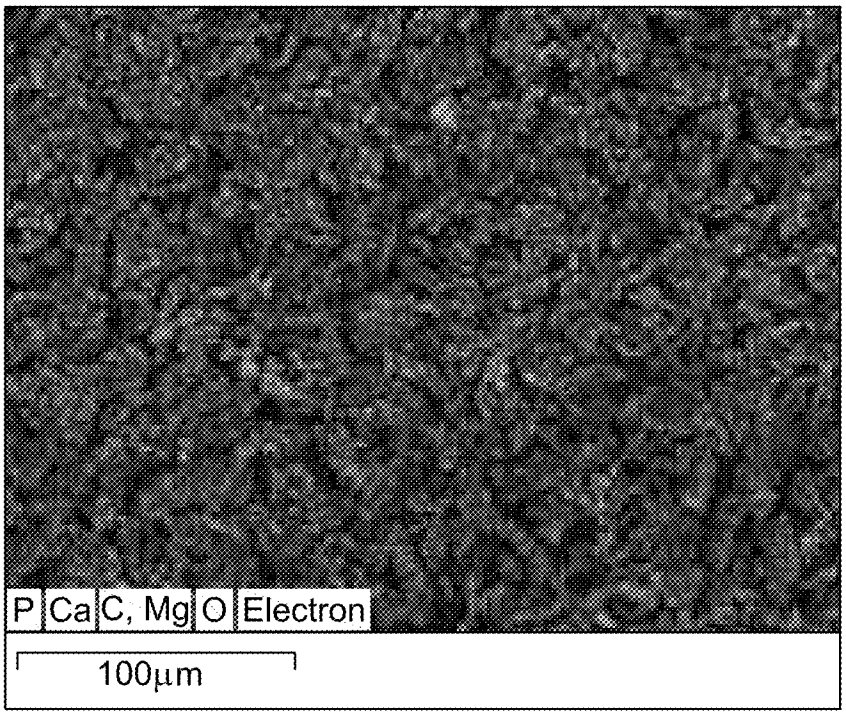
Figure 5B:
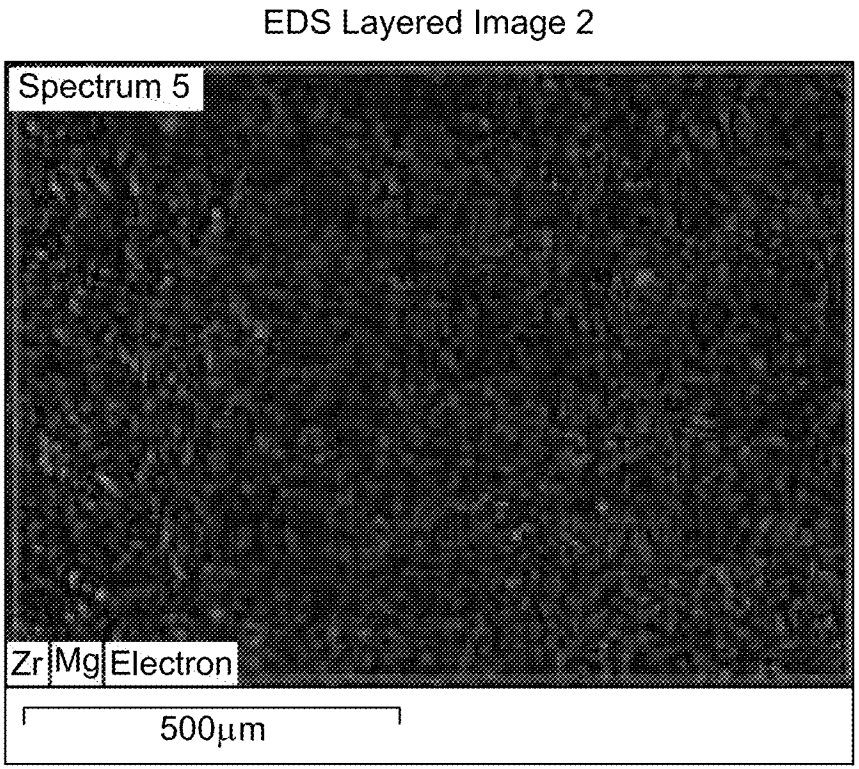
FIG. 5B shows an SEM image, and corresponding elemental map of the Mg-1Zr mixed powder, according to certain embodiments.
Figure 5B:
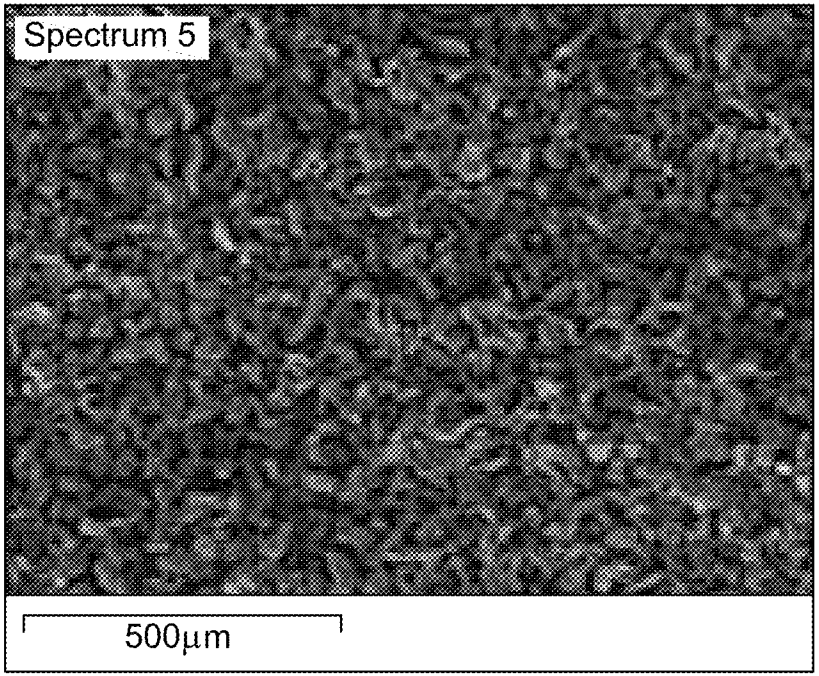
Figure 5C:
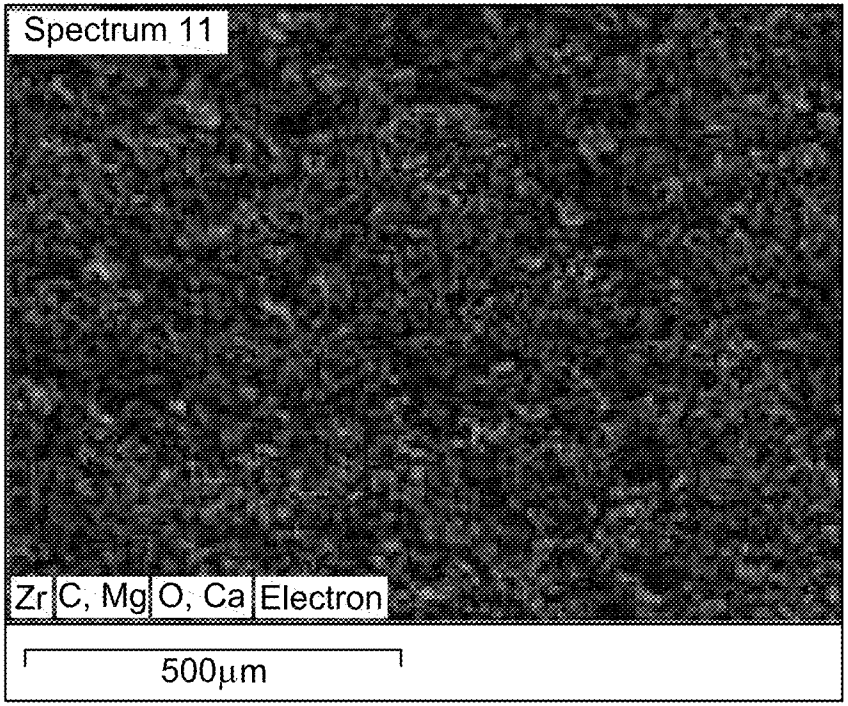
FIG. 5C shows an SEM image, and corresponding elemental map of the Mg-1Zr-2.5ES powder mixture, according to certain embodiments.
Figure 5C:
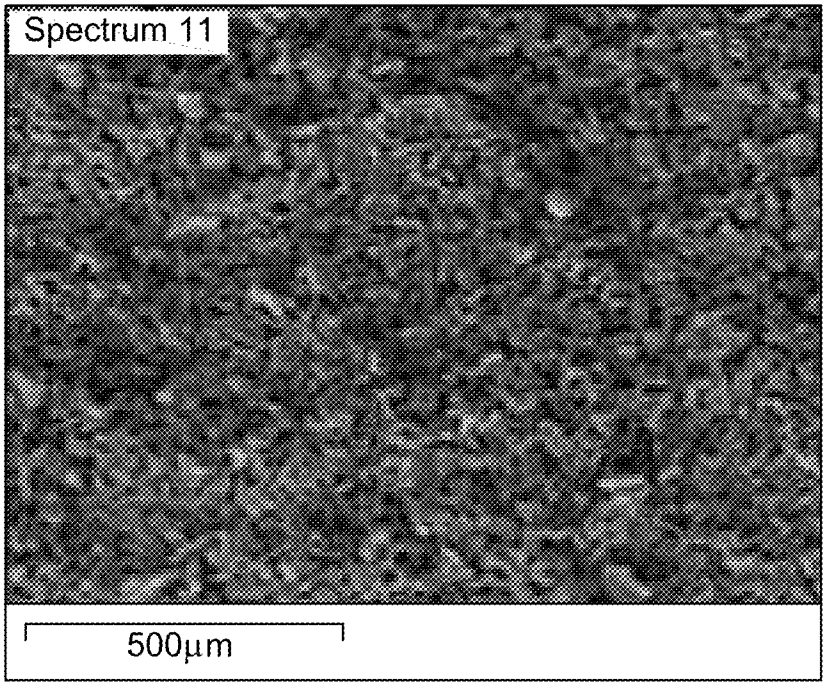

Referring now to FIG. 5A-5C, the SEM micrographs and corresponding elemental maps of Mg-2.5ES powder mixture (FIG. 5A), Mg-1Zr mixed powder (FIG. 5B), and Mg-1Zr-2.5ES powder mixture (FIG. 5C) revealed a uniform distribution of zirconium and ES particles throughout the magnesium matrix.

Figure 6A:
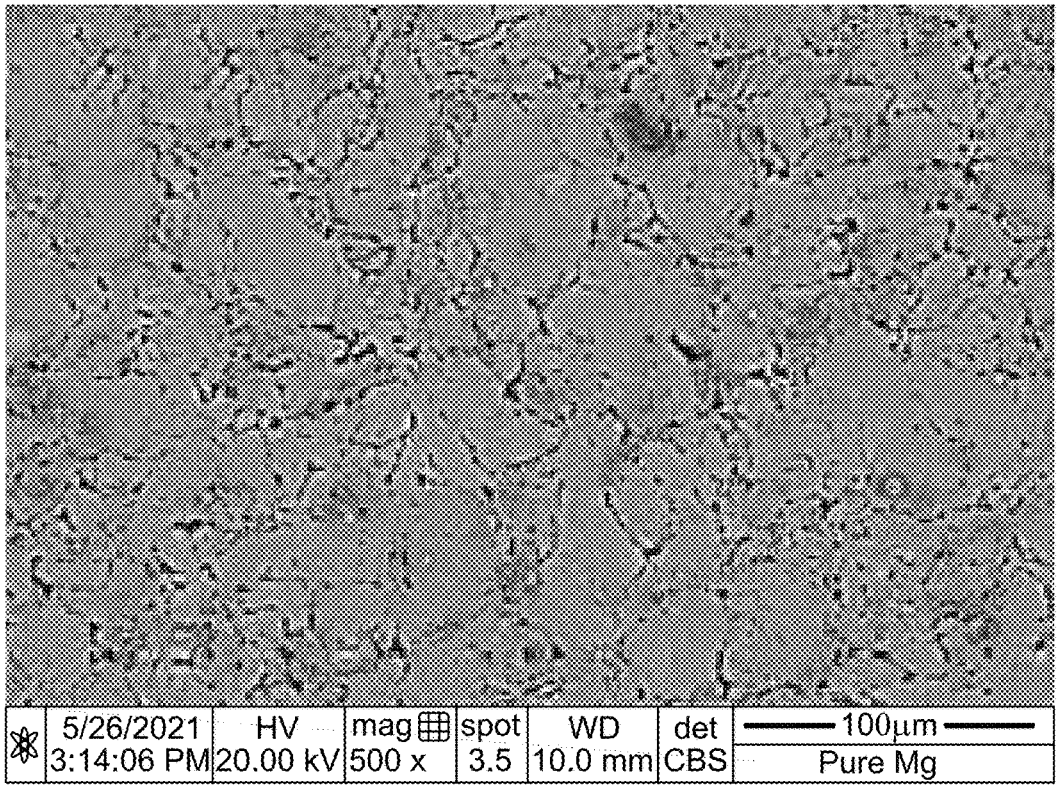
FIG. 6A shows an SEM micrograph of the sintered magnesium, according to certain embodiments.
Figure 6B:
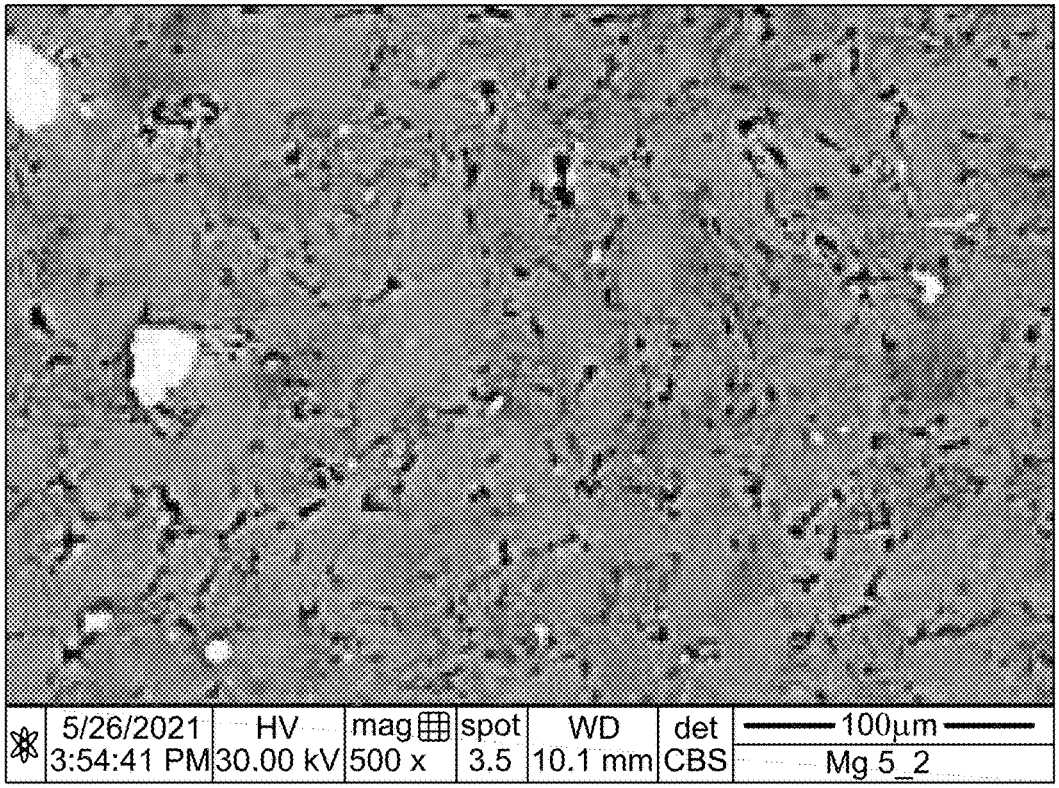
FIG. 6B shows an SEM micrograph of the sintered Mg-1Zr, according to certain embodiments.
Figure 6C:
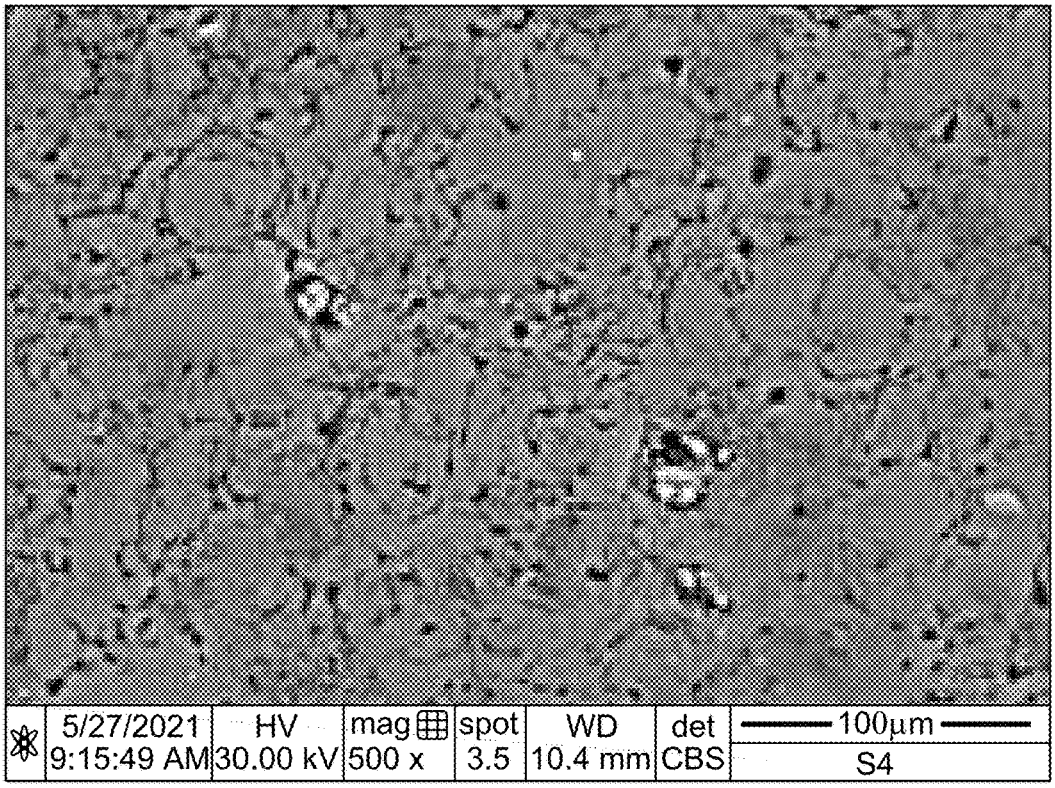
FIG. 6C shows an SEM micrograph of the Mg-2.5ES composite, according to certain embodiments.
Figure 6D:
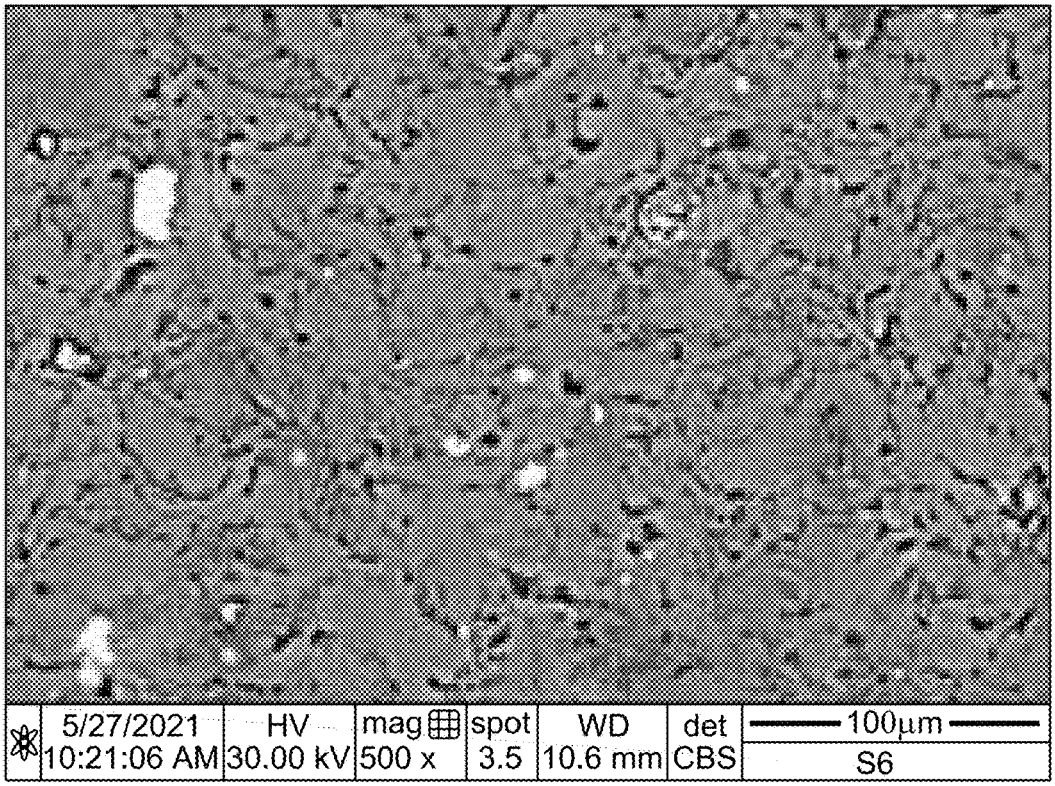
FIG. 6D shows an SEM micrograph of the Mg-1Zr-2.5ES composite, according to certain embodiments.

Referring now to FIG. 6A-6D, the SEM micrograph of sintered magnesium (FIG. 6A), Mg-2.5ES composite (FIG. 6B), sintered Mg-1Zr (FIG. 6C), and Mg-1Zr-2.5ES composite (FIG. 6D) revealed a uniform distribution of zirconium and ES particles throughout the magnesium matrix. Magnesium appears to be the gray phase in the SEM micrograph (FIG. 6A), while reinforcement particles appear to be the white phase (FIG. 6B-6D). Additionally, the SEM micrographs revealed no visible porosity in the metal matrix composite.

Figure 7A:
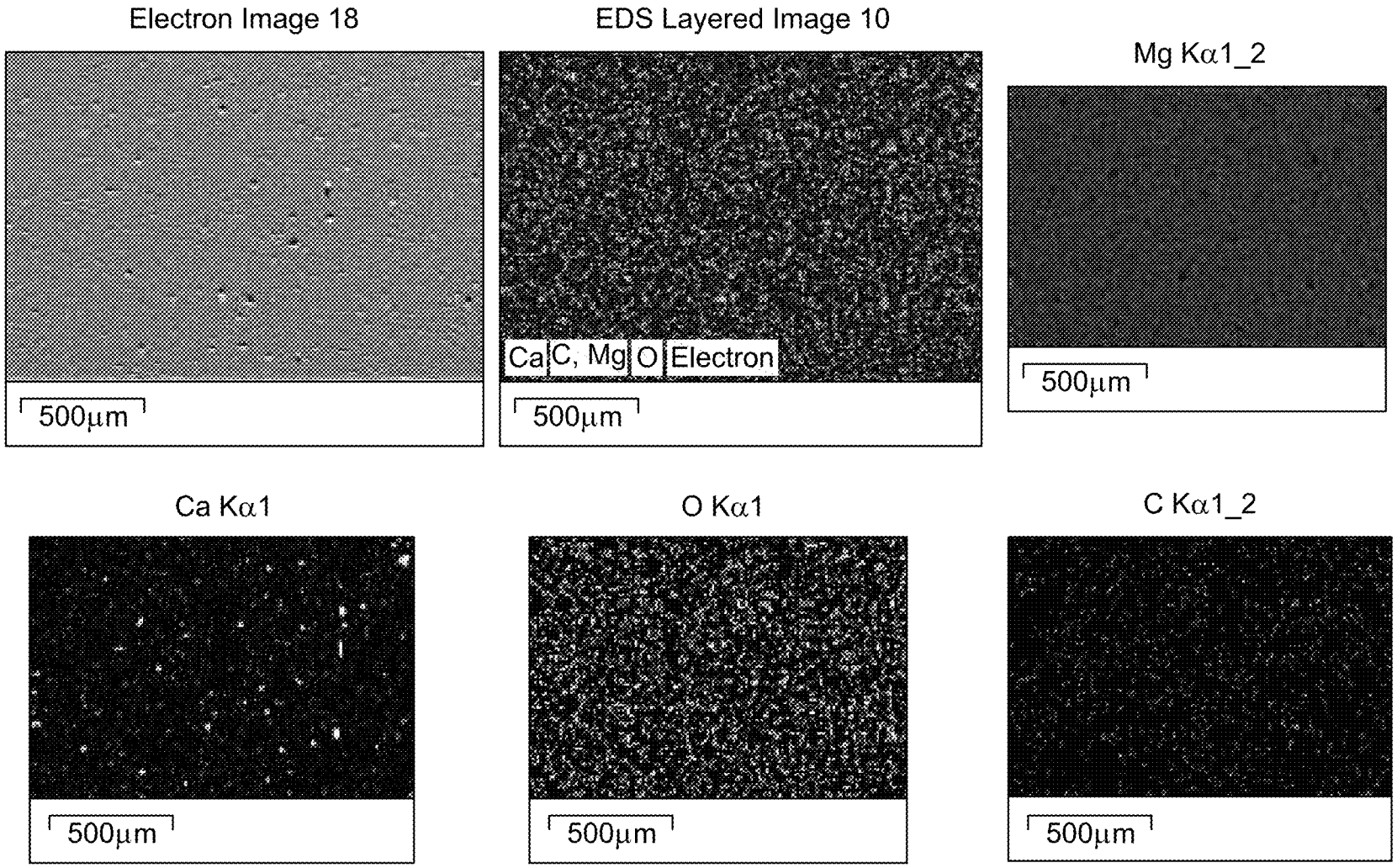
FIG. 7A shows an SEM image and corresponding EDX maps of the Mg-2.5ES composite, according to certain embodiments.
Figure 7B:
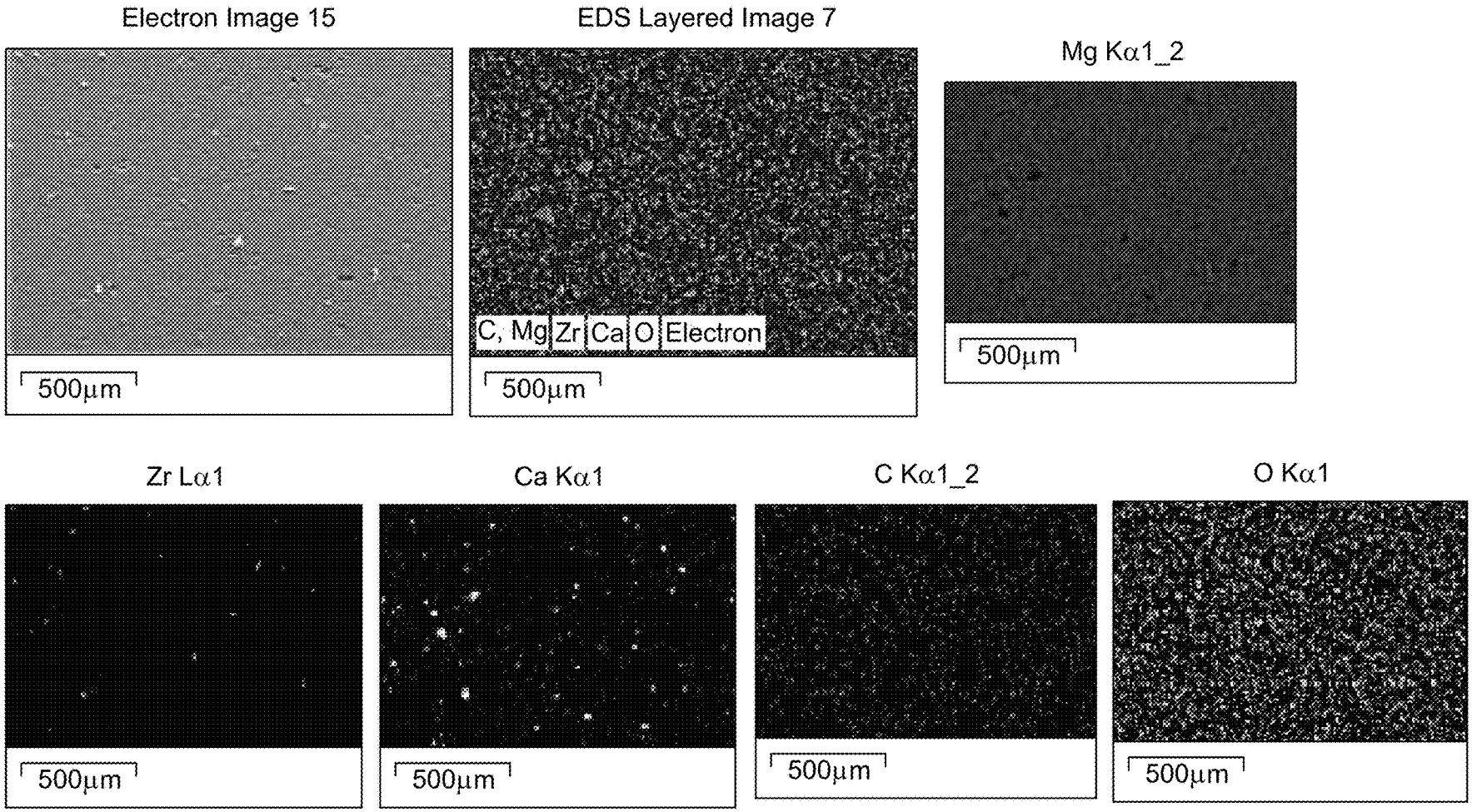
FIG. 7B shows an SEM image and corresponding EDX maps of the Mg-1Zr-2.5ES composite, according to certain embodiments.

Referring now to FIGS. 7A & 7B, the SEM micrographs and corresponding elemental maps of Mg-2.5ES composite (FIG. 7A), and Mg-1Zr-2.5ES composite (FIG. 7B) revealed a uniform distribution of zirconium and ES particles throughout the magnesium matrix in the metal matrix composite.

Example 3c: Density Analysis

Archimedes principle was used to determine the density of polished samples by following ASTM B962-17 standards.

The sample weight was determined, wherein a density measurement kit integrated within a scale was used to determine the weight of samples taken in air or water [Hussein et al., Mater. Des. 83, 344-351, 2015]. The following equation (1) was used to determine the experimental density of the sample:

$$\rho_{ex} = \left(\frac{A}{A-B}\right) * (\rho_1 - \rho_a) + \rho_a \quad (1)$$

Wherein $\rho_{ex}$ is sample's experimental density, A is weight of the sample measured in air, B is weight of the sample measured in water, $\rho_1$ is density of water and $\rho_a$ is density of air.

Referring now to Table 1, the experimental density of Mg-1Zr-2.5ES composite was higher than the sintered magnesium. The average relative densities of sintered Mg-1Zr, Mg-2.5ES composite, and Mg-1Zr-2.5ES composite were determined to be 99.65%, 98.9%, and 99.2%, respectively. The results indicated that a near-dense material was manufactured utilizing the processing conditions of the invention. However, the observed porosity of 1.1% in the Mg-2.5ES composite could be a result of ES particles agglomerating in the magnesium matrix. The reduced porosity (i.e. 0.8%) of the Mg-1Zr-2.5ES composite may be a result of the improved interfacial bonding between the ES and the magnesium matrix, which is useful in suppressing grain development during the sintering. The metal matrix composite showed density close to cancellous bone and cortical bone.

TABLE 1

Density and porosity of the analyzed materials.

| Material | Theoretical density ($g/cm^3$) | Experimental density ($g/cm^3$) | Porosity (%) |
|---|---|---|---|
| Sintered magnesium | 1.738 | 1.738 | 0.0 |
| Mg-1Zr | 1.75 | 1.74 | 0.343 |
| Mg-2.5ES | 1.751 | 1.73 | 1.1 |
| Mg-1Zr-2.5ES | 1.764 | 1.75 | 0.80 |
| Cortical bone | 1.8-2.0* | — | — |
| Cancellous bone | 1.0-1.4* | — | — |

*Bommala et al., J. Magnes. Alloy. 7, 72-79, 2019

Example 3d: Microhardness Analysis

Microhardness was determined using HV test (ASTM E384-08) by employing a 50-gf load and a dwell length of 15 seconds. Each sample was tested at least eight times in a straight line and an average value was calculated.

Referring now to Table 2, the microhardness value of sintered magnesium, sintered Mg-1Zr, Mg-2.5ES composite, and Mg-1Zr-2.5ES composite is shown in Table 2. An increase in the microhardness value of Mg-2.5ES composite (+3%), and Mg-1Zr-2.5ES composite (+6.4%) was observed when compared to sintered magnesium.

TABLE 2

Microhardness value of the analyzed materials.

| Material | Microhardness (HV) |
|---|---|
| Sintered magnesium | 49.72 |
| Mg-1Zr | 56.59 (+13.8%) |

TABLE 2-continued

Microhardness value of the analyzed materials.

| Material | Microhardness (HV) |
|---|---|
| Mg-2.5ES | 51.28 (+3%) |
| Mg-1Zr-2.5ES | 52.89 (+6.4%) |

Example 3e: In-Vitro Corrosion Analysis in a Physiological Medium

The bio-corrosion performance of the metal matrix composite was assessed by analyzing their in-vitro corrosion properties. Corrosion-resistant behavior in the physiological medium was evaluated using an electrochemical station, Gamry Potentiostat instrument through the three-electrode cell setup in which the metal matrix composite behave as a working electrode, whereas graphite rod and saturated calomel electrode used as counter and reference electrodes, respectively. Hank's solution was prepared using the previous report [Qiu et al., Mater. Sci. Eng. C 36, 65-76, 2014] and the exposed area was about 1.76 $cm^2$. Before all the electrochemical testing, open circuit potential (OCP) was monitored for about 30 minutes to attain a steady-state of the investigated system. Linear polarization resistance (LPR) measurements were achieved by selecting a potential of ±25 mV with a scan rate of 0.1967 mV/s. Electrochemical impedance spectroscopy (EIS) was performed by selecting a frequency region of 1 kHz to 1 mHz using 10 mV perturbation signal. Potentiodynamic polarization (PDP) measurements were carried out by applying a potential of ±0.250 mV vs OCP with a scan rate of 1 mV/s. All the test results were analyzed using an inbuilt software, Echem analysis, and the obtained results were replicated to ensure the reproducibility of the data.

Referring now to FIG. 8, the OCP values with a function of the immersion period were monitored as it provides a preliminary information on the corrosion-resistant and the obtained curves are presented in FIG. 8. The period required to achieve a stable OCP value is varied from 1 minute to 10 minutes. Sintered magnesium acquired more time to reach a steady-state OCP than sintered Mg-1Zr, Mg-2.5ES composite, and Mg-1Zr-2.5ES composite. In particular, Mg-1Zr-2.5ES composite engaged minimum time to attain a steady-state with a lesser degree of fluctuations. Furthermore, a noble corrosion potential of −1.5126 V was detected for Mg-1Zr-2.5ES composite as compared with sintered magnesium. The obvious shift of OCP was identified in the case of Mg-1Zr-2.5ES composite, primarily indicating enhanced corrosion-resistance obtained by addition of zirconium and ES particles.

Referring now to FIG. 9, which illustrate LPR curves of sintered magnesium, sintered Mg-1Zr, Mg-2.5ES composite, and Mg-1Zr-2.5ES composite in Hank's medium.

Referring now to Table 3, the estimated parameters such as corrosion current density ($i_{corr}$), corrosion potential ($E_{corr}$), and polarization resistance ($R_p$) of sintered magnesium, sintered Mg-1Zr, Mg-2.5ES composite, and Mg-1Zr-2.5ES composite are given in Table 3. Mg-1Zr-2.5ES composite showed a positive shift in $E_{corr}$ value when compared with sintered magnesium, which reveals the improved electrochemical stability in Hank's medium. Further, $i_{corr}$ value of sintered magnesium was found to be about 80.5190 μA $cm^2$, whereas this value was pointedly reduced to 12.3401 μA $cm^2$ for Mg-1Zr-2.5ES composite, revealing the reduction in the corrosion rate. In addition, the $R_p$ value of Mg-1Zr-2.5ES composite was found to be higher than the sintered magnesium, which further validated the improvement in the corrosion-resistant behavior.

TABLE 3

Electrochemical parameters from LPR curve.

| Substrate | $E_{corr}$ (mV) | $I_{corr}$ (μA cm$^2$) | $\beta_a$ (mV/dec) | $\beta_b$ (mV/dec) | $R_p$ (Ω cm$^2$) |
|---|---|---|---|---|---|
| Sintered magnesium | −1.6352 | 80.5190 | 89 | 57 | 187.35 |
| Mg-1Zr | −1.5665 | 43.8972 | 64 | 73 | 430.91 |
| Mg-2.5ES | −1.5989 | 51.8245 | 82 | 93 | 365.21 |
| Mg-1Zr-2.5ES | −1.554 | 12.3401 | 74 | 88 | 1413.05 |

Referring now to FIG. 10, which illustrate the representative PDP curves of sintered magnesium, sintered Mg-1Zr, Mg-2.5ES composite, and Mg-1Zr-2.5ES composite in Hank's medium.

Referring now to Table 4, the estimated values from the Tafel extrapolation analysis of the PDP curves are summarized. It is well known that the magnesium exhibits an electrochemical activity without showing passivation behavior [Cao et al., Corros. Sci. 111, 835-845, 2016]. The most negative $E_{corr}$ and highest $i_{corr}$ value was shown by sintered magnesium, revealing its lowest corrosion-resistant behavior. Whereas Mg-1Zr-2.5ES composite exhibited most positive $E_{corr}$ value of −1.5021 V and lowest $i_{corr}$ values of 23.1293 μA cm$^2$, validating the improvement of in-vitro corrosion protection performance. It's also obvious from Table 4 that the estimated corrosion rate for the metal matrix composite is lower than the sintered magnesium, further corroborating the positive synergetic effect of the zirconium and ES particles in the magnesium matrix in enhancing the anti-corrosion behavior in Hank's medium.

TABLE 4

Electrochemical parameters from Tafel plot analysis.

| Substrate | $E_{corr}$ (mV) | $I_{corr}$ (μA cm$^2$) | $\beta_a$ (mV/dec) | $\beta_b$ (mV/dec) | Corrosion Rate (mm/year) |
|---|---|---|---|---|---|
| Sintered magnesium | −1.5984 | 264.9602 | 79 | 94 | 12.1031 |
| Mg-1Zr | −1.5417 | 67.2034 | 73 | 86 | 3.0326 |
| Mg-2.5ES | −1.5893 | 84.3321 | 65 | 93 | 3.8103 |
| Mg-1Zr-2.5ES | −1.5021 | 23.1293 | 78 | 81 | 1.0450 |

Figure 11:
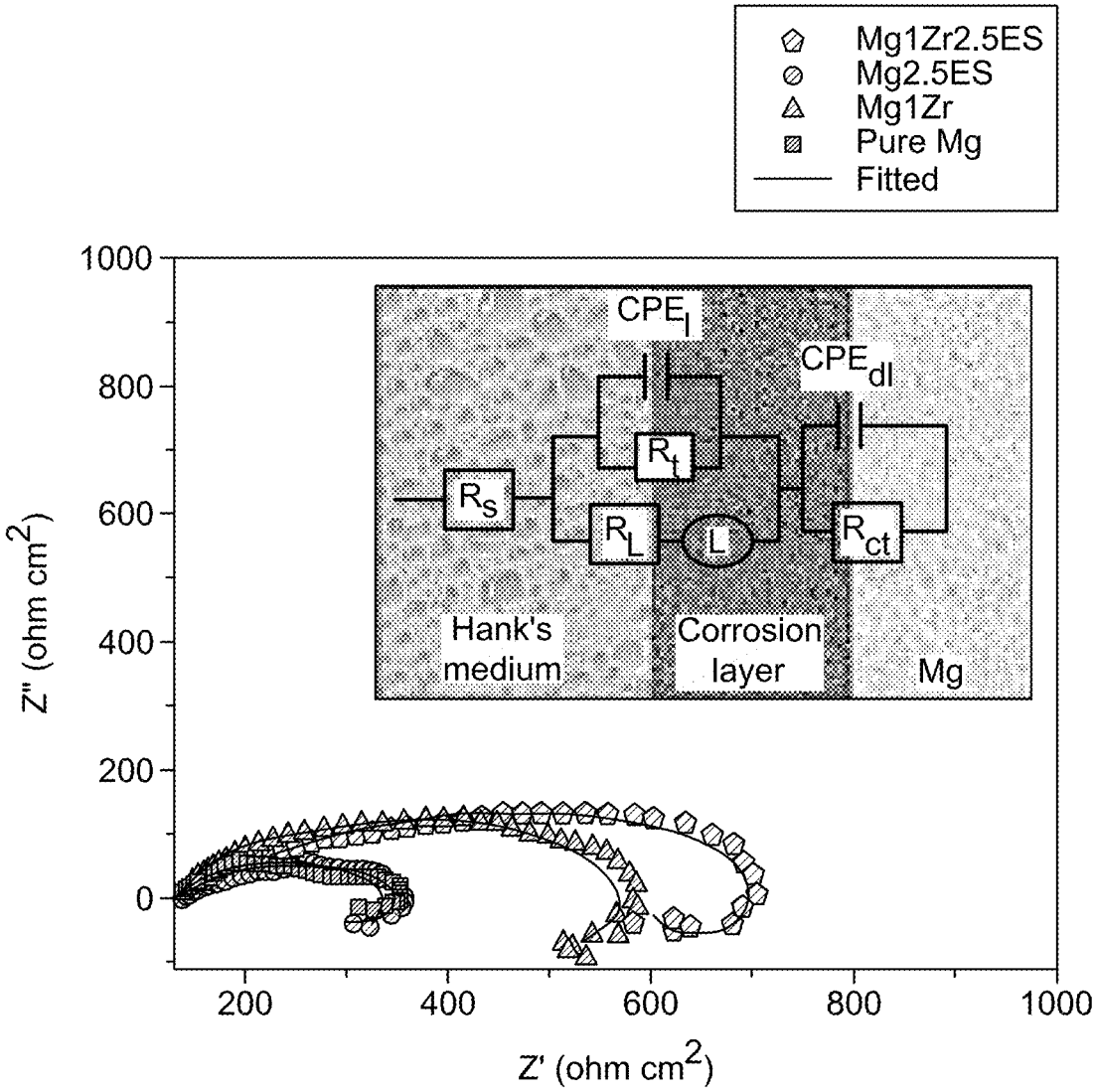
FIG. 11 shows Nyquist curves of materials in Hank's medium, according to certain embodiments.

Referring now to FIG. 11, Nyquist curves exhibited one distorted capacitive arc at high and intermediate frequency regions followed by an inductive loop at the low-frequency region. The capacitive arc at high-frequency regions is attributed to the electrochemical double layer and charge transfer response, while the inductive loop at low frequencies is ascribed to the attached magnesium intermediates including $Mg^+$ and $Mg(OH)^+$ ions on substrate's surface [Jayaraj et al., Corros. Sci. 113, 104-115, 2016].

Referring now to FIG. 12, impedance of the magnesium was found to be about 300 Ω cm$^2$, whereas the impedance of the Mg-1Zr-2.5ES composite was about 700 Ω cm$^2$ in the same frequencies. A high value of the impedance modulus in the low frequencies is a general indicator of its better performance, and considering the impedance values from the FIG. 12, the protective performance offered by these materials can be ranked as sintered magnesium <Mg-2.5ES <Mg-1Zr <Mg 1-Zr-2.5ES.

To analyze the obtained EIS curves further, an equivalent circuit fitting procedure was executed by selecting the appropriate EIS model and the estimated parameters are shown in Table 5.

Referring now to Table 5, comparing the obtained $R_{ct}$ values as shown in Table 5, it's clear that Mg-1Zr-2.5ES composite displayed the highest $R_{ct}$ values, validating its enhanced corrosion-resistant performance in Hank's medium. Further, $CPE_{dl}$ value of Mg-1Zr-2.5ES composite was found to be one order magnitude lower than sintered magnesium, verifying that infusion of violent components from electrolyte towards the magnesium surface proscribed by the enhanced barrier performance due to the zirconium and ES particles in the magnesium matrix.

TABLE 5

EIS parameters from the equivalent circuit fitting procedure.

| Substrate | $R_s$ (Ω cm$^2$) | $R_{ct}$ (Ω cm$^2$) | $CPE_{dl}$ ($\Omega^{-1}$ cm$^{-2}$s$^n$) | $n_{dl}$ |
|---|---|---|---|---|
| Sintered magnesium | 98.4326 | 302.4194 | 112.9836 | 0.96 |
| Mg-1Zr | 101.7658 | 556.4390 | 50.4398 | 0.97 |
| Mg-2.5ES | 104.2954 | 328.4309 | 73.2905 | 0.96 |
| Mg-1Zr-2.5ES | 101.3496 | 701.2945 | 32.6839 | 0.97 |

Obviously, numerous modifications and variations of the present disclosure are possible in light of the above teachings. It is therefore to be understood that within the scope of the appended claims, the invention may be practiced otherwise than as specifically described herein.

The invention claimed is:

1. A method to form a metal matrix composite reinforced with eggshell(ES), comprising:

blending and milling a powder consisting of at least one magnesium (Mg) powder and at least one zirconium (Zr) powder and at least one ES powder to form a powder mixture;

compacting the powder mixture in a press to form a compacted powder mixture; and sintering the compacted powder mixture to form a composite matrix by making the compacted powder mixture coalesce into a solid or porous mass by heating it without complete liquifaction;

wherein said at least one Mg powder has a particle size in a range of 20 to 70 micrometers (μm);

wherein said at least one Zr powder has a particle size in a range of 20 to 60 μm;

wherein after the sintering, the composite matrix consists of magnesium, zirconium, and ES; and wherein the amount of magnesium in the composite matrix is from 89.9 to 99.9 wt. %, the amount of zirconium in the composite matrix is from 0.1 to 10 wt. %, and the amount of ES in the composite matrix is from 0.1 to 10 wt. %.

2. The method of claim 1, wherein:

the amount of magnesium in the composite matrix is from 95 to 97 wt. %, the amount of zirconium in the composite matrix is from 1 to 2 wt. %, and the amount of ES in the composite matrix is from 1 to 4 wt. %.

3. The method of claim 1, further comprising:

heating, drying and crushing the eggshell(ES) to form a crushed ES; and grinding the crushed ES to form the ES powder, wherein the ES powder has a reduced particle size compared to the crushed ES.

4. The method of claim 3, wherein:

the ES powder has an irregular size and shape; and the ES powder has an average particle size in a range of 1 to 10 μm.

5. The method of claim 3, wherein:

the ES powder has a peak in a range of 2 theta (θ) value 28 to 32° in an XRD spectrum.

6. The method of claim 1, wherein:

the composite matrix has a density of from 1.7 to 2.0 $g/cm^3$.

7. The method of claim 1, wherein:

the composite matrix has a microhardness of from 30 to 80 vickers pyramid number (HV).

8. The method of claim 1, wherein:

Zr and ES are uniformly distributed throughout the composite matrix.

9. The method of claim 1, wherein after the sintering of the compacted powder mixture, the composite matrix has a densification of from 90 to 100%.

10. The method of claim 1, wherein after the sintering of the compacted powder mixture, the composite matrix has a densification of from 98% to 99.9%.

11. The method of claim 1, wherein the milling of the powder mixture occurs at a speed of from 175 to 225 rotations per minute (rpm);

wherein the compacting of the powder mixture occurs at a pressure of from 300 to 800 megapascal (MPa); and wherein the sintering of the compacted powder mixture occurs at a temperature of from 300 to 600 degrees Celsius (°° C.).

12. The method of claim 1, wherein after the sintering of the compacted powder mixture, said composite matrix has a corrosion potential ($E_{corr}$) value of from −1.7 to −1.4 voltage (V).

13. The method of claim 1, wherein after the sintering of the compacted powder mixture, said composite matrix has a current density ($I_{corr}$) value of from 20 to 280 microampere per square centimeter ($\mu A/cm^2$).

14. The method of claim 1, wherein the compacted powder mixture is a compacted Mg-1 wt % Zr-2.5 wt % ES powder mixture, and is sintered at 450° C. in an argon atmosphere.

15. The method of claim 1, wherein after the sintering of the compacted powder mixture, SEM micrographs reveal no visible porosity in the metal matrix composite.

* * * * *